US012734640B2

(12) United States Patent
Yun et al.

(10) Patent No.: US 12,734,640 B2
(45) Date of Patent: Sep. 15, 2026

(54) METHOD FOR REFRESHING POLISHING PAD AND METHOD FOR MANUFACTURING SEMICONDUCTOR DEVICE USING THE SAME

(71) Applicants: SK enpulse Co., Ltd., Gyeonggi-do (KR); SK hynix Inc., Gyeonggi-do (KR)

(72) Inventors: Sung Hoon Yun, Seoul (KR); Jang Won Seo, Seoul (KR); Jae Gon Choi, Gyeonggi-do (KR)

(73) Assignees: ENPULSE CO., LTD., Chungcheongnam-do (KR); SK hynix Inc., Gyeonggi-do (KR)

( * ) Notice: Subject to any disclaimer, the term of this patent is extended or adjusted under 35 U.S.C. 154(b) by 697 days.

(21) Appl. No.: 17/946,528

(22) Filed: Sep. 16, 2022

(65) Prior Publication Data

US 2023/0091382 A1 Mar. 23, 2023

(30) Foreign Application Priority Data

Sep. 17, 2021 (KR) ..... 10-2021-0124631

(51) Int. Cl.
*B24B 53/017* (2012.01)

(52) U.S. Cl.
CPC ..... *B24B 53/017* (2013.01)

(58) Field of Classification Search
USPC ..... 451/443, 444
See application file for complete search history.

(56) References Cited

U.S. PATENT DOCUMENTS 6,632,127 B1 * 10/2003 Zimmer ..... B24B 53/017 451/286
2014/0287586 A1 9/2014 Matsui et al.
2020/0376522 A1 12/2020 Wu et al.
2020/0406310 A1 12/2020 Soundararajan et al.

FOREIGN PATENT DOCUMENTS

CN 113276016 A 8/2021
JP 2014183221 A 9/2014
JP 2022538104 A 8/2022
(Continued)

OTHER PUBLICATIONS

Machine Translation of KR 20190044307 to Seo et al. (Year: 2019).*

(Continued)

*Primary Examiner* — Monica S Carter
*Assistant Examiner* — Jonathan R Zaworski
(74) *Attorney, Agent, or Firm* — IP & T GROUP LLP

(57) ABSTRACT

The present disclosure relates to a method for refreshing a polishing pad, and, through increasing a useful life of a polishing pad used in a polishing process, is capable of reducing the amount of discarded polishing pad, and significantly enhancing polishing efficiency by shortening the time required to replace the polishing pad. In addition, a method for manufacturing a semiconductor device is a manufacturing process using the method for refreshing a polishing pad, wherein a polishing pad having the period of usage ended is reusable by having polishing performance equivalent to a new polishing pad, and process efficiency may be enhanced by reducing the number of replacements of polishing pads.

9 Claims, 9 Drawing Sheets

(56) References Cited

FOREIGN PATENT DOCUMENTS

| | | | | |
|---|---|---|---|---|
| KR | 10-2004-0016495 | A | | 2/2004 |
| KR | 10-2015-0098574 | A | | 8/2015 |
| KR | 10-2019-0044307 | A | | 4/2019 |
| KR | 20190044307 | A | * | 4/2019 |
| KR | 10-2021-0106479 | A | | 8/2021 |
| TW | 202032091 | A | | 9/2020 |
| TW | 202110576 | A | | 3/2021 |

OTHER PUBLICATIONS

Extended European Search Report for the European Patent Application No. 22195851.5 issued by the European Patent Office on Jan. 31, 2023.
Office Action for the Korean Patent Application No. 10-2021-0124631 issued by the Korean Intellectual Property Office on Sep. 12, 2023.
Office Action for the Taiwanese Patent Application No. 111135220 issued by the Taiwanese Patent Office on Jun. 9, 2023.
Office Action on the Japanese Patent Application No. 2022-148494 issued by the Japanese Patent Office on Oct. 3, 2023.
Office Action for Chinese Patent Application No. 202211127672.X issued by the Chinese Patent Office on Mar. 27, 2025.

* cited by examiner

[FIG. 1]
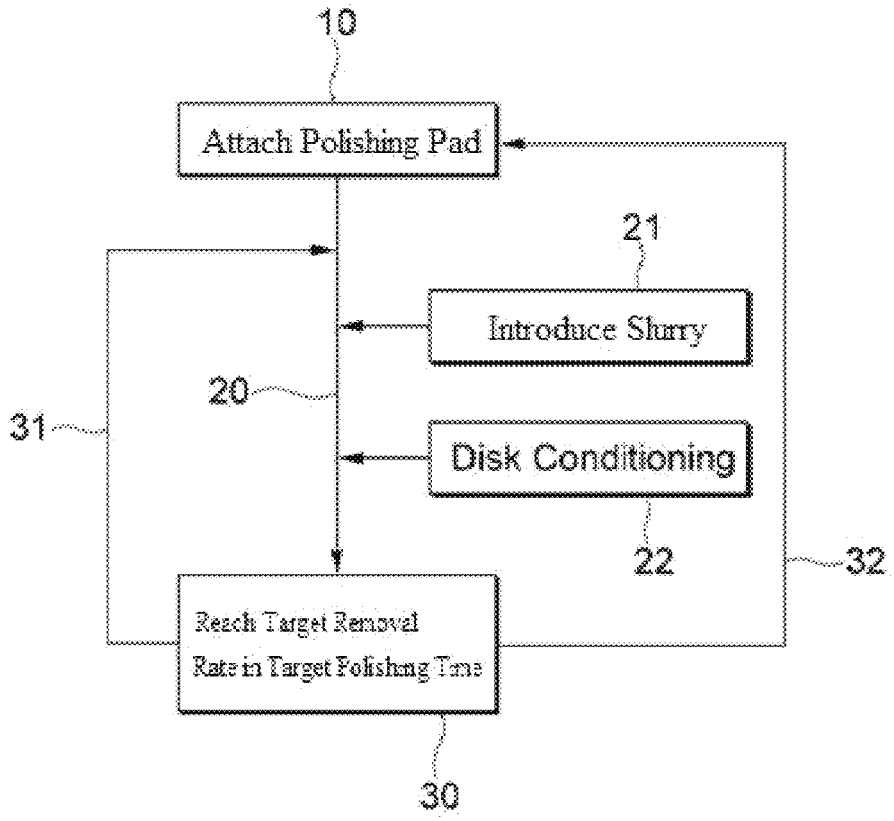

[FIG. 2]
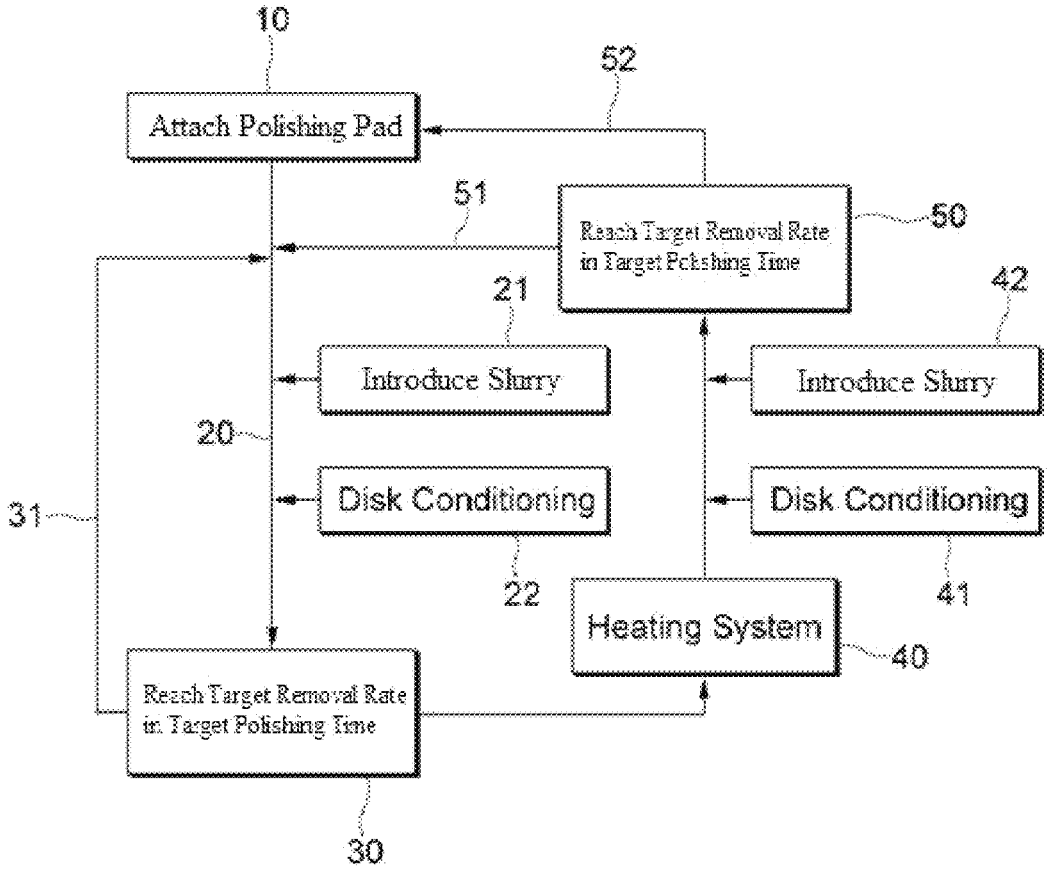

[FIG. 3]
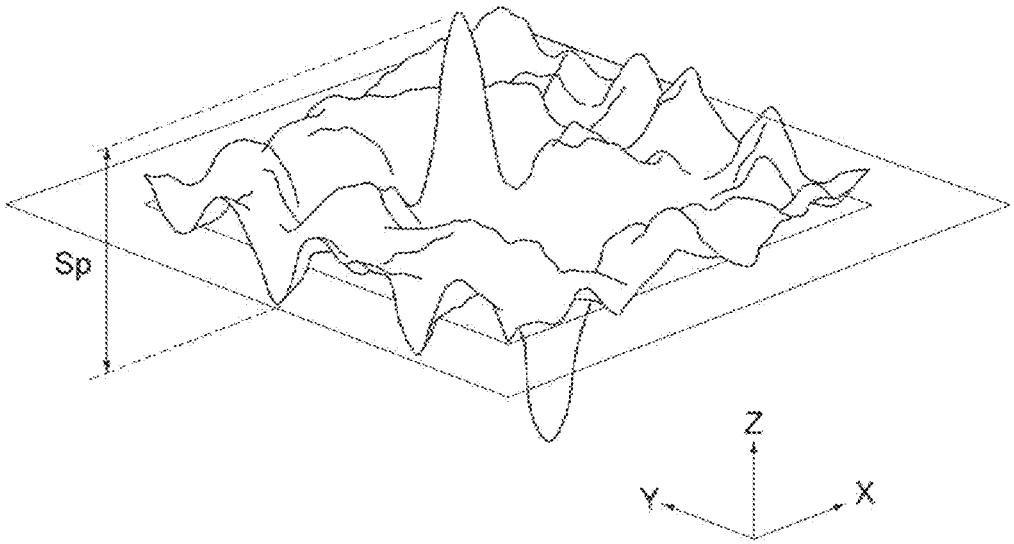
[FIG. 4]
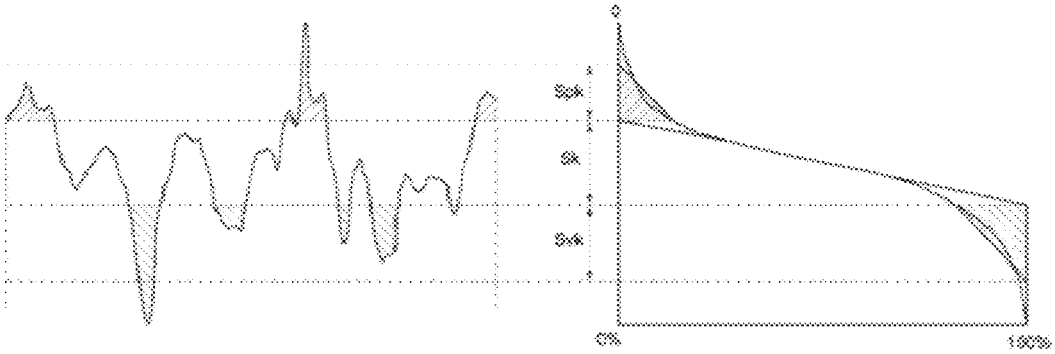

[FIG. 5]
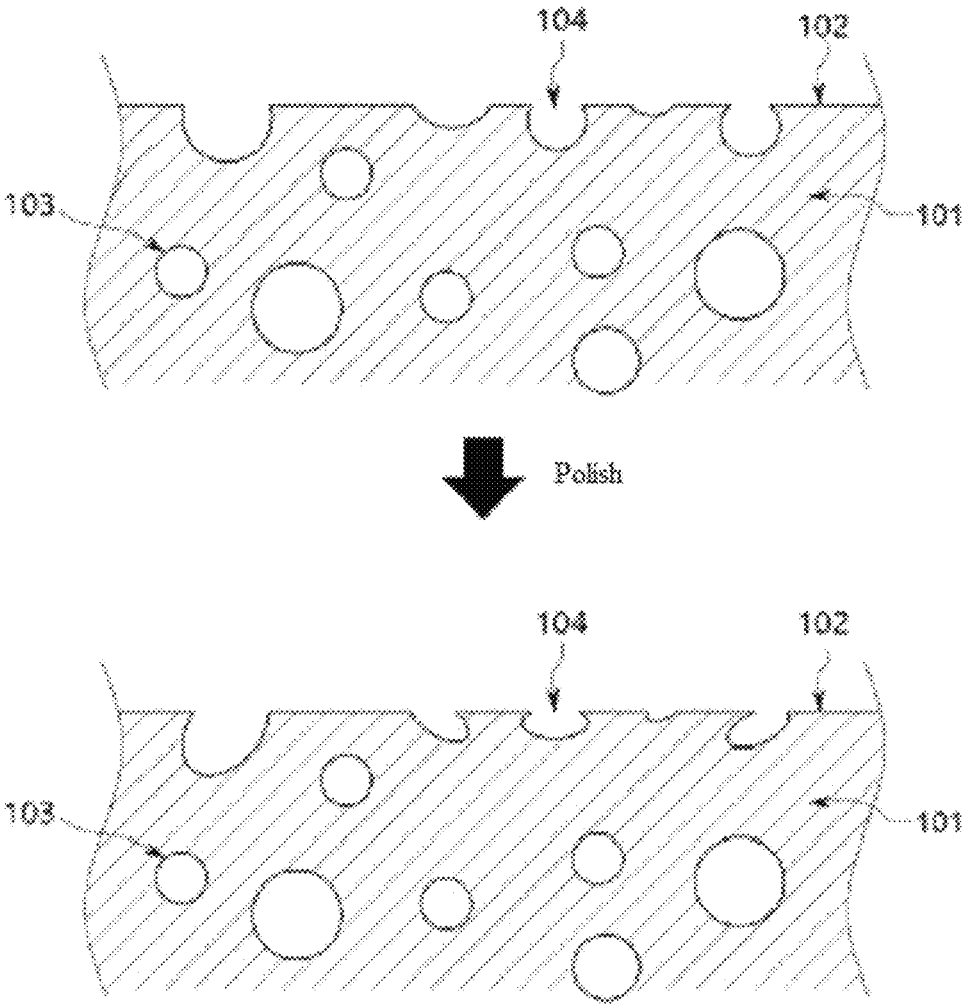

[FIG. 6]
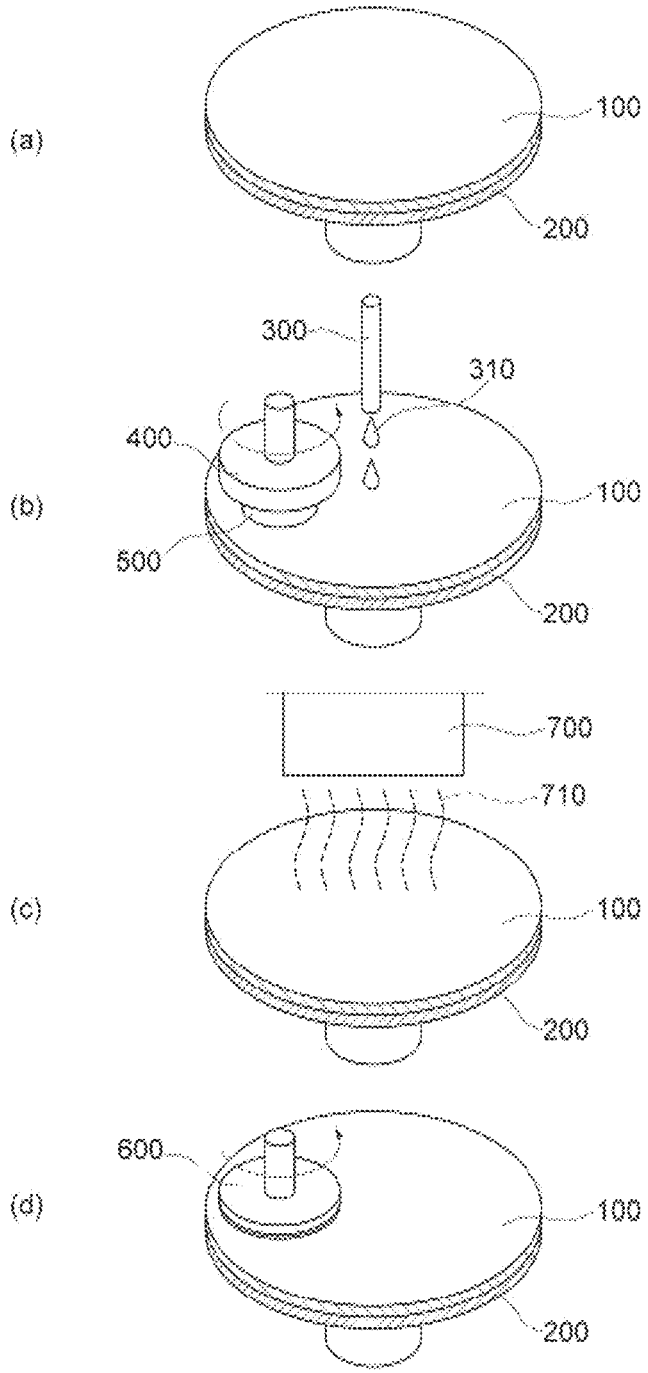

[FIG. 7]
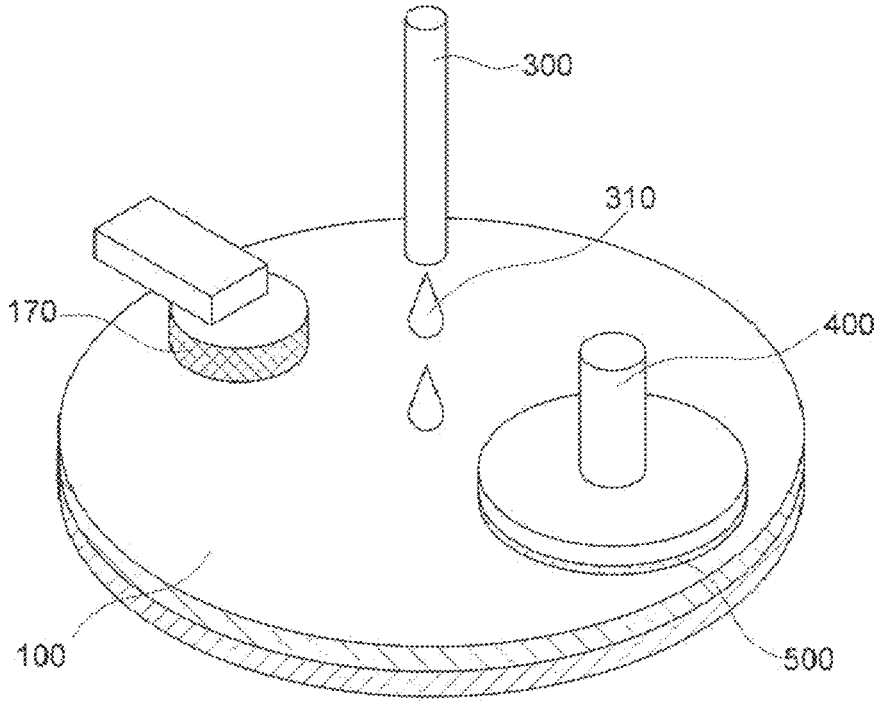

[FIG. 8]
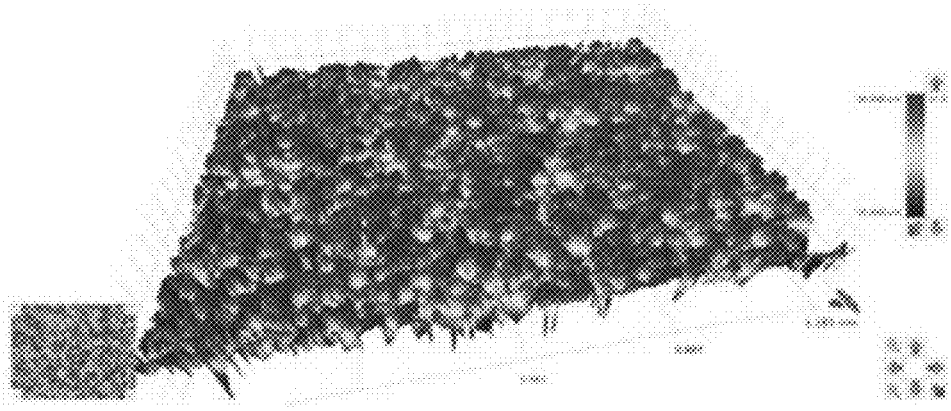
[FIG. 9]
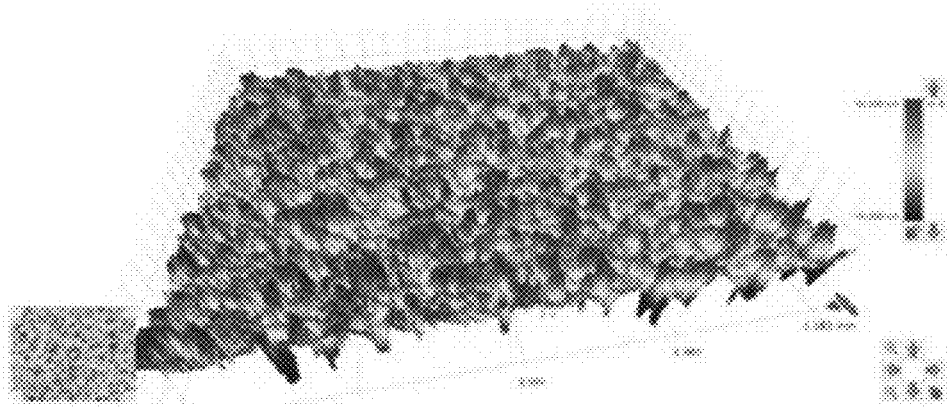

[FIG. 10]
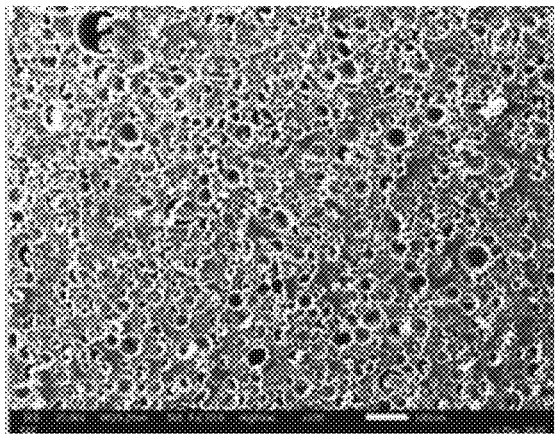
[FIG. 11]
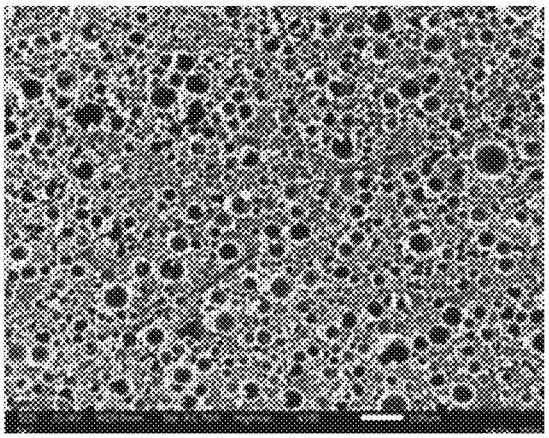

[FIG. 12]
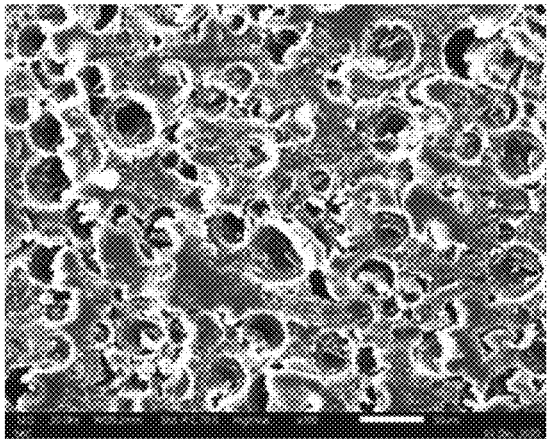
[FIG. 13]
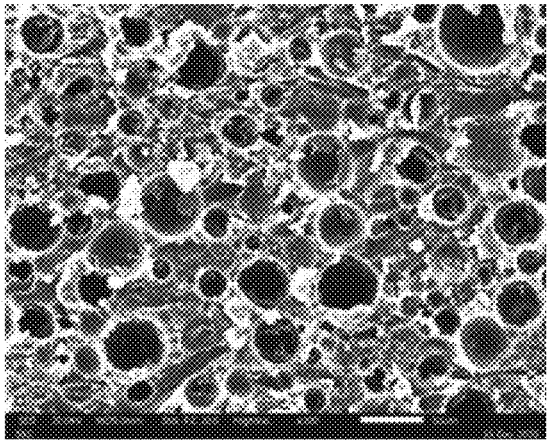

METHOD FOR REFRESHING POLISHING PAD AND METHOD FOR MANUFACTURING SEMICONDUCTOR DEVICE USING THE SAME

CROSS-REFERENCE TO RELATED APPLICATION(S)

This application claims benefit of priority to Korean Patent Application No. 10-2021-0124631 filed on Sep. 17, 2021 in the Korean Intellectual Property Office, the disclosure of which is incorporated herein by reference in its entirety.

TECHNICAL FIELD

The present disclosure relates to a method for refreshing a polishing pad, and relates to a method for manufacturing a semiconductor device using the method for refreshing a polishing pad and an apparatus for manufacturing a semiconductor device.

BACKGROUND ART

A chemical mechanical planarization (CMP) or chemical mechanical polishing (CMP) process may be performed for various purposes in various technical fields. The CMP process is performed on a predetermined surface to be polished of a subject to be polished, and may be performed for the purposes of planarizing the surface to be polished, removing aggregated materials, relieving crystal lattice damages, removing scratches and contamination sources, and the like.

The CMP process technique of a semiconductor process may be classified depending on film quality of a subject to be polished or the surface shape after polishing. For example, the technique may be divided into single silicon or polysilicon depending on film quality of a subject to be polished, and may be classified into CMP processes of various oxide films or metal films such as tungsten (W), copper (Cu), aluminum (Al), ruthenium (Ru) and tantalum (Ta) divided by the type of impurities. In addition, depending on the surface shape after polishing, the technique may be classified into a process of mitigating substrate surface roughness, a process of planarizing a level caused by multilayer circuit wiring, and a process of device isolation for selectively forming circuit wiring after polishing.

The CMP process may be applied a plurality of times in a process for manufacturing a semiconductor device. A semiconductor device includes a plurality of layers, and each layer may include a complex and fine circuit pattern. In addition, recent semiconductor devices have evolved in the direction of reducing individual chip sizes and the pattern of each layer being more complicated and finer. Accordingly, the purpose of the CMP process has been expanded not only to the purpose of planarizing circuit wiring but also to applications of separating circuit wiring and improving a wiring surface in the process for manufacturing a semiconductor device, and as a result, CMP performance that is more sophisticated and reliable has been required.

A polishing pad used in such a CMP process is a process component processing a surface to be polished to a required level through friction, and is considered as one of the most important factors in thickness uniformity of a subject to be polished after polishing, flatness of the polished surface, polishing quality and the like.

As for the polishing pad used in the CMP process, the polishing process is performed on a predetermined surface to be polished of a subject to be polished for the purposes of planarizing the surface to be polished, removing aggregated materials, relieving crystal lattice damages, removing scratches and contamination sources, and the like, and when polishing performance of the polishing pad declines due to the repetition of polishing process, the polishing pad may be replaced, and the used polishing pad may be discarded.

The used polishing pad is not able to be reused, and the discard may cause environmental pollution problems. In order to prevent such problems, there is a need for a method for treating a polishing pad usable in a polishing process longer than its existing useful life.

DISCLOSURE

Technical Problem

The present disclosure is directed to providing a method for refreshing a polishing pad capable of increasing a useful life of a polishing pad used in a polishing process, thereby reducing an amount of waste of the polishing pad.

The present disclosure is also directed to providing a method for manufacturing a semiconductor device capable of, by using the method for refreshing a polishing pad, increasing a useful life of a polishing pad and extending a replacement cycle of the polishing pad in the polishing process, thereby significantly enhancing efficiency in the process for manufacturing a semiconductor device.

The present disclosure is also directed to providing an apparatus for manufacturing a semiconductor device capable of increasing a useful life of a polishing pad used in a polishing process.

Technical Solution

In view of the above, one embodiment of the present disclosure provides a method for refreshing a polishing pad, the method including supplying water vapor to a polishing pad, wherein the polishing pad includes a polishing layer provided with a polishing surface, the polishing layer includes a plurality of pores, and the polishing surface includes a fine concave portion derived from the plurality of pores.

Another embodiment of the present disclosure provides a method for manufacturing a semiconductor device, the method including: installing a polishing pad including a polishing surface on a surface plate; arranging a surface to be polished of a subject to be polished to be in contact with the polishing surface, and then polishing the subject to be polished while rotating the polishing pad and the subject to be polished relative to each other under a pressurized condition; and supplying water vapor to the polishing surface of the polishing pad.

Still another embodiment of the present disclosure provides an apparatus for manufacturing a semiconductor device, the apparatus including: a surface plate on which a polishing pad is installed; a carrier in which a semiconductor substrate is installed; and a water vapor spray unit, wherein the water vapor spray unit supplies water vapor to the polishing pad installed on the surface plate.

Advantageous Effects

The present disclosure relates to a method for refreshing a polishing pad capable of increasing a useful life of a polishing pad used in a polishing process, thereby reducing an amount of waste of the polishing pad.

In addition, by using the method for refreshing a polishing pad, a useful life of the polishing pad increases, which can significantly enhance efficiency of a process for manufacturing a semiconductor device by reducing the number of replacements of the polishing pads in the polishing process.

BRIEF DESCRIPTION OF DRAWINGS

FIG. 1 is a flowchart for a polishing process.

FIG. 2 is a flowchart for a polishing process including a method for refreshing a polishing pad.

FIG. 3 is a schematic diagram for a three-dimensional surface roughness parameter.

FIG. 4 is a schematic diagram for Svk and Spk that are surface roughness parameters.

FIG. 5 is a diagram on changes in the shapes of fine concave portions formed on a polishing surface of a polishing pad by a polishing process.

FIG. 6 is a conceptual diagram for a polishing apparatus according to one embodiment of the present disclosure.

FIG. 7 is a conceptual diagram for a polishing apparatus according to one embodiment of the present disclosure.

FIG. 8 is a 3D image of a polishing pad surface according to one embodiment of the present disclosure.

FIG. 9 is a 3D image of a polishing pad surface according to one embodiment of the present disclosure.

FIG. 10 is an SEM image for a polishing surface according to one embodiment of the present disclosure.

FIG. 11 is an SEM image for a polishing surface according to one embodiment of the present disclosure.

FIG. 12 is an SEM image for a polishing surface according to one embodiment of the present disclosure.

FIG. 13 is an SEM image for a polishing surface according to one embodiment of the present disclosure.

BEST MODE

Advantages and features of the present disclosure, and methods to achieve these advantages and features will become clear when referencing embodiments or examples to describe below. However, the present disclosure is not limited to the embodiments or examples disclosed below, and may be embodied in various forms different from each other. The embodiments or examples specified below are provided to make the disclosure of the present disclosure complete and to make known the category of the disclosure to those skilled in the art, and the scope of a right of the present disclosure is defined by the category of claims.

In drawings, as necessary, thicknesses of some constitutions are enlarged in order to clearly express a layer or region. In addition, in drawings, thicknesses of some layers and regions are exaggerated for the convenience of description. Throughout the specification, like reference numerals are used for like elements.

In the present specification, when a part such as a layer, a film, a region or a plate is referred to be "on" or "above" another part, this is interpreted to include not only a case where it is "directly on" the another part, but also a case where there is still another part therebetween. When a certain part is "directly on" another part, it is interpreted to mean that no other part is present in the middle. In addition, when a part such as a layer, a film, a region or a plate is referred to be "under" or "below" another part, this is interpreted to include not only a case where it is "directly under" the another part, but also a case where there is still another part therebetween. When a certain part is "directly under" another part, it is interpreted to mean that no other part is present in the middle.

In the present specification, a meaning of '~ or greater' in indicating a numerical range is interpreted to include a case of the corresponding number or numbers higher than that. For example, '2 or greater' means a case of 2 or numbers higher than that. In addition, a description of 'X to Y' regarding a numerical range is interpreted as a range including X or Y. For example, '25 to 50' means a numerical range including 25 and 50.

In the present specification, a constitution modified as 'first', 'second' or the like is used to, since parent constitutions including the same are different from each other, modify and describe only to distinguish these, and such a description itself is not interpreted to include components or compositions different from each other.

In the present specification, a 'state immediately before supplying water vapor to the polishing pad' means a case corresponding to any one of a state 1 minute to 10 minutes before supplying water vapor to the polishing pad and a state where surface roughness (Sa) of a polishing surface of the polishing pad is from 3 μm to 4.5 μm or less, or cases corresponding to both.

In the present specification, a 'state immediately after supplying water vapor to the polishing pad' means 1 minute to 10 minutes after the supply of water vapor is stopped.

In the present specification, a 'polishing pad failing to reach a target removal rate' means a case of a removal rate being 1,800 Å/min or less under a process condition of polishing a silicon oxide film for 60 seconds while calcined ceria slurry is supplied at a rate of 200 mL/minute, a semiconductor substrate, a subject to be polished, is pressurized with a load of 3.5 psi, the polishing pad has a rotation speed of 93 rpm and the semiconductor substrate has a rotation speed of 87 rpm.

In the present specification, a 'polishing pad failing to reach target within-wafer nonuniformity' means a case of within-wafer nonuniformity being 9% or less under a process condition of polishing a silicon oxide film for 60 seconds while calcined ceria slurry is supplied at a rate of 200 mL/minute, a semiconductor substrate, a subject to be polished, is pressurized with a load of 3.5 psi, the polishing pad has a rotation speed of 93 rpm and the semiconductor substrate has a rotation speed of 87 rpm.

In the present specification, 'refresh' means a polishing pad used in a polishing process, a polishing pad failing to reach a target removal rate and/or a polishing pad failing to reach target within-wafer nonuniformity having the useful lifetime increased through i) supplying water vapor, or ii) treatment such as water vapor supply and conditioning.

In the present specification, "last" relates to a period of time taken for supplying water vapor while the used polishing pad is installed on a surface plate, and means a period of time during which a semiconductor substrate used in a polishing process is detached from a carrier, a new semiconductor substrate is installed in the carrier, and a polishing process starts again.

Hereinafter, illustrative embodiments according to the present disclosure will be described in detail.

One embodiment of the present disclosure may provide a method for refreshing a polishing pad, the method including supplying water vapor to a polishing pad, wherein the polishing pad includes a polishing layer provided with a polishing surface, the polishing layer includes a plurality of pores, and the polishing surface includes a fine concave portion derived from the plurality of pores.

FIG. 1 is a flowchart for an existing polishing system. Specifically, a polishing pad is installed on a surface plate, a semiconductor substrate is installed in a carrier (10), and after arranging a surface to be polished of the semiconductor substrate in the carrier to be in contact with a polishing layer of the polishing pad, a polishing process may progress by relative rotation under a pressurized condition (20).

The polishing process may progress by introducing slurry to the polishing surface (21), and relatively rotating the semiconductor substrate installed in the carrier while being in contact with the polishing surface. At the same time, a conditioning process (22) of the polishing layer may progress by a conditioner.

The conditioning process (22) may be for maintaining polishing performance of the polishing layer at a certain level or higher. Specifically, the polishing pad includes a polishing layer provided with a polishing surface, the polishing layer includes a plurality of pores, the polishing surface includes a fine concave portion derived from the plurality of pores, and the fine concave portion may cause decline in the polishing performance due to processing residues and reaction products by the polishing process. In order to prevent such decline in the polishing performance, the conditioning process (22) may prevent clogging by processing residues and reaction products in the fine concave portion, hereby maintaining polishing performance.

However, the conditioning process (22) is a process of shaving the surface of the polishing layer, and repeating the conditioning process (22) itself does not maintain polishing performance at the same level as the initial polishing pad.

In other words, the polishing pad maintains polishing performance at a certain level or higher by the conditioning process (22) when the polishing process is conducted, however, polishing performance of the polishing pad declines by the repeated polishing process, and in this case, the polishing pad of which polishing performance has declined may be replaced.

Whether to replace the polishing pad may be checked through whether the actual polishing process progresses within a target polishing time range (30). When the polishing process progresses and time taken for the polishing process is maintained within the target polishing time range (31), the polishing process continuously progresses without replacing the polishing pad, and when time taken for the polishing process exceeds the target polishing time range (32), the polishing pad is replaced, and the replaced polishing pad is not reusable.

In the polishing process, hours of use of the polishing pad vary depending on properties of the polished surface in the semiconductor substrate, and sometimes, the polishing pad is replaced faster than the degree used in the polishing process.

In other words, when the number of polishing pads used in the polishing process increases and the amount of discarded polishing pads increases therefrom, a problem of environmental pollution may be caused. In addition, since the polishing process progresses as a continuous process, the polishing process is interrupted in order to replace the polishing pad as above, which may cause a problem of reducing efficiency of a semiconductor device manufacturing process.

In order to prevent such a problem, the present disclosure relates to a method for refreshing a polishing pad, the method including supplying water vapor to a polishing pad.

FIG. 2 is a flowchart for a polishing process using the method for refreshing a polishing pad of the present disclosure. In the same order as in FIG. 1, a polishing pad is installed (10), and then a polishing process progresses (20).

When the polishing process progresses, whether the actual polishing process progresses within a target polishing time range may be checked (30). In the existing polishing process as in FIG. 1, the polishing process progresses (31) when the step (30) falls within the target polishing time range, and when the step (30) does not fall within the target polishing time range, the polishing pad is replaced (32).

However, in the present disclosure, a polishing pad failing to fall within the target polishing time range is not replaced, and water vapor of 50° C. to 120° C. may be supplied thereto for 1 minute to 10 minutes (40) to increase a useful life of the polishing pad.

By the supplying of water vapor to a polishing pad (40), shapes of the fine concave portions of the polishing surface derived from the plurality of pores included in the polishing layer may change. In one embodiment, a rate of change in the surface roughness (Sa) of the polishing surface in the polishing layer caused by the change in the shape of the fine concave portion represented by the following Equation 1 may be from 30% to 70%:

$$(Sa_r - Sa_f)/Sa_f \times 100 \quad \text{[Equation 1]}$$

herein, $Sa_f$ is surface roughness (Sa) of the polishing surface before supplying water vapor to the polishing pad, and $Sa_r$ is surface roughness (Sa) of the polishing surface after supplying water vapor to the polishing pad.

The three-dimensional arithmetic mean surface roughness Sa is a parameter three-dimensionally extending a surface roughness parameter Ra, and means an average of Z (x, y) absolute values on the film surface. In other words, Sa means an arithmetic mean height when a valley area in the three-dimensional image is converted into an absolute value and changed to a peak. The Sa is an average of differences in the average heights of average surfaces, and is one of most widely used parameters. The parameter is not affected much by scratches, contamination and measurement noise.

The rate of change in the surface roughness (Sa) of the polishing surface may be from 30% to 70%, 40% to 69%, and 43% to 68% by Equation 1. In the above-mentioned range, the shape of the fine concave portion of the polishing surface changes by water vapor supply, and the degree of change in the shape of the fine concave portion may affect a removal rate (RR) and within-wafer nonuniformity (WIWNU).

Spk that is another three-dimensional surface roughness parameter is a value for an average height of peaks protruding above the center of the polishing layer, and Svk is a value for an average height of grooves protruding below the center of the polishing layer.

The Spk and the Svk are defined using the Abbott curve, and the Abbott curve of FIG. 4 represents height distribution of the surface material. This is a cumulative function of a material fraction of the surface at a specific depth below the highest peak of the surface. In other words, the Abbott curve represents that the surface material fraction increases as the depth of the roughness profile increases. The material fraction is 0% at the highest peak, however, the material fraction is 100% at the deepest point (or "valley"). A minimum secant slope, that is, an optimally defined line, divides the Abbott curve into the following three ranges:

a) core roughness depth Sk [μm], that is, depth of roughness core profile b) reduced peak height Spk [μm], that is, average height of peaks protruding above the Sk, and c) reduced valley depth Svk [μm], that is, average depth of grooves protruding below the Sk Those affecting polishing performance such as a removal rate and within-wafer nonuniformity may be surface roughness of the polishing layer. Particularly, parameters for evaluating changes before/after abrasion may be Spk and Svk. The polishing layer of the polishing pad goes through a change in the polishing layer surface roughness by the polishing process, and due to the change in the surface roughness, polishing performance may decline. Abrasion generally proceeds at the highest part of the surface, and in order to evaluate the state of abrasion, checking the degree of change through a parameter based on height distribution may be important.

In one embodiment, a rate of change in Svk of the polishing surface represented by the following Equation 4 may be from 0.5% to 50%:

$$(Svk_r - Svk_f)/Svk_f \times 100 \quad \text{[Equation 4]}$$

herein, $Svk_f$ is surface roughness (Svk) of the polishing surface before supplying water vapor to the polishing pad, and $Svk_r$ is surface roughness (Svk) of the polishing surface after supplying water vapor to the polishing pad.

The rate of change in Svk of the polishing surface calculated by Equation 4 may be from 0.5% to 50%, from 10% to 45% and from 15% to 42%. From the results of checking the rate of parameter changes for evaluating the state of abrasion, the degree of change may be identified as well compared to before supplying water vapor to the polishing pad, which means that the polishing pad may be refreshed by supplying water vapor.

The method for refreshing a polishing pad of the present disclosure may further include conditioning (41). Specifically, a polishing pad is installed on a surface plate (10), and a polishing process may progress (20). When the polishing process progresses (20), whether the actual polishing process progresses within a target polishing time range may be checked (30). When the step (30) falls within the target polishing time range, the polishing process progresses (31), and when the step does not fall within the target polishing time range, the polishing pad is not replaced, and water vapor of 50° C. to 120° C. is supplied to the polishing pad for 1 minute to 10 minutes (40), and conditioning (41) is conducted to increase a useful life of the polishing pad.

In the supplying of water vapor (40), water vapor of 50° C. to 120° C. may be supplied for 1 minute to 10 minutes. The water vapor temperature may be from 50° C. to 120° C., from 60° C. to 120° C., from 70° C. to 120° C. from 50° C. to 110° C., from 60° C. to 110° C., and from 70° C. to 110° C. Supplying water vapor in the above-mentioned temperature range changes the shape of the fine concave portion and changes surface roughness of the polishing surface due to the change in the shape, and as a result, polishing performance is improved, and the polishing pad may be refreshed. Water vapor of 120° C. or lower is used to prevent corrosion of polishing equipment and to stably maintain and manage polishing equipment, however, the temperature is not limited to the above-mentioned range, and any water vapor may be used without being limited to the above-mentioned temperature range as long as it changes surface roughness of the polishing surface and allows refreshing of the polishing pad.

In the supplying of water vapor, the water vapor may be supplied for 1 minute to 10 minutes, for 1 minute to 10 minutes, for 2 minutes to 8 minutes, for 3 minutes to 7 minutes, for 4 minutes to 6 minutes, for 4 minutes to 8 minutes, and for 4 minutes to 10 minutes. When supplying the water vapor in the above-mentioned time range, the polishing pad may be refreshed by changing surface roughness of the polishing surface. In addition, by supplying water vapor in the above-mentioned time range, the time range of water vapor supply for refreshing the polishing pad is optimized in the polishing process, which refreshes the polishing pad in a short period of time compared to replacement of the polishing pad, such that efficiency of the polishing process may be optimized.

The conditioning (41) is shaving the surface of the polishing layer to change the degree of surface roughness. In the method for refreshing a polishing pad of the present disclosure, polishing performance of the polishing pad may be enhanced by the conditioning (41) as well as the supplying of water vapor to the polishing pad (40). Polishing performance may be enhanced by changing the shape of the fine concave portion through supplying water vapor to the polishing pad, and then changing surface roughness through the conditioning process.

Specifically, the polishing pad includes a polishing layer provided with a polishing surface, the polishing layer includes a plurality of pores, and the polishing surface may include a fine concave portion derived from the plurality of pores. As in FIG. 5, the fine concave portion formed on the polishing surface may not maintain a concave shape by the polishing process, and a gentle groove may be formed. The polishing surface including the gentle groove has a low degree of surface roughness, reducing polishing performance, which makes it impossible to use in the polishing process.

The gentle groove may be partially restored to a shape similar to the original shape when supplying water vapor (40), and by the additional conditioning process (41), surface roughness equivalent to the fine concave portion shape before the polishing process may be obtained.

The supplying of water vapor to a polishing pad (40) may be conducted while the polishing pad is installed on a surface plate. Specifically, the polishing pad is installed on a surface plate to be used in the polishing process, and after used in the polishing process, the progress of the actual polishing process within a target polishing time range is checked (30), and when failing to fall within the range, water vapor is supplied to the polishing pad (40), and conditioning (41) may be conducted. Herein, the supplying of water vapor to the polishing pad (40) and the conditioning (41) may progress while the polishing pad is installed on a surface plate.

In other words, in order to refresh the polishing pad, water vapor is supplied (40) and conditioning (41) is conducted while the polishing pad is installed on a surface plate, which may minimize processes introduced to refresh the polishing pad.

As another example, the supplying of water vapor to a polishing pad (40) may be conducted while the polishing pad is detached from a surface plate. The polishing pad detached as above is cleaned, and water vapor may be supplied to the polishing pad (40). The water vapor-supplied polishing pad is installed on the surface plate, and then conditioned (41) to be reused.

The supplying of water vapor to a polishing pad (40) may be classified depending on whether the polishing pad is attached to a surface plate. The method of supplying water vapor (40) and conditioning (41) while being attached to a surface plate has a simpler process by skipping the step of detaching the polishing pad from a surface plate, and, compared to the method of supplying water vapor after detaching from a surface plate to describe later, surface roughness may be relatively highly restored. The surface roughness being highly restored differs by whether vapor water is supplied in a short period of time after the polishing process is finished. This is due to the fact that, when water vapor is supplied after the polishing surface of the polishing layer including porous polyurethane is deformed by the polishing process, surface roughness may be restored to a high level using a property of the porous polyurethane being restored to its original shape. On the other hand, when time passes after the polishing process is finished, the restoring property of the porous polyurethane is reduced, resulting in a difference in the surface roughness even though water vapor is supplied to the polishing surface.

On the other hand, in the method for refreshing a polishing pad in which the polishing pad is detached from a surface plate, a process of detaching the surface plate is added and surface roughness is relatively low after refreshing compared to in the method for refreshing of supplying water vapor while the polishing pad is attached on the surface plate described above. However, the polishing pad separated from the surface plate may be separately washed and foreign substances generated during the polishing process may be removed, and therefore, an occurrence of defects caused by the foreign substances may be prevented in the polishing process performed after the refreshing process.

After that, the polishing pad having the useful life increased may be subject to a polishing process. Examining of whether to replace the secondary polishing pad (50) after that is determining whether the refreshed polishing pad exceeds a target polishing time range, and when polishing progresses exceeding the target polishing time range, the polishing pad may be discarded (52), and may be replaced with a new polishing pad.

Specifically, the polishing layer of the polishing pad according to the method for refreshing of the present disclosure has a polishing restoration index (PRI) represented by the following Equation 2 of 3.10 to 3.80:

$$PRI = \frac{(S_{pk} + S_{vk})}{S_a} \quad \text{[Equation 2]}$$

herein,

Sa is an ISO 25178 three-dimensional arithmetic mean surface roughness Sa value, Spk is a value for an average height of peaks protruding from the center of the surface of the polishing layer, and Svk is a value for an average height of grooves protruding downward from the center of the surface of the polishing layer.

The polishing restoration index (PRI) may mean to significantly affect polishing performance, that is, polishing performance depending on the degree of change in the surface roughness value relating to a removal rate (RR) and within-wafer nonuniformity (WIWNU).

The PRI represents the degree of restoration on polishing performance, in which the numerator is the sum of Spk and Svk and the denominator is Sa, and is a value obtained from dividing the sum of an average height of peaks protruding from the center of the polishing layer and an average height of grooves protruding downward from the center of the polishing layer by an average of differences in the average heights of the average surfaces, and uniformity of the surface roughness may be identified through a numerical value. When the PRI value falls within the range of the present disclosure, a high level of polishing performance may be obtained.

In addition, including the PRI value in the range of the present disclosure indicates that the sum of an average height of peaks protruding from the center of the polishing layer and an average height of grooves protruding downward from the center of the polishing layer increases by the water vapor supply, which means that the fine concave portion of the polishing surface of which shape has changed by the polishing process is restored to its original shape, and the polishing surface has a reduced glazed portion and is thereby usable again in the polishing process, and as a result, the useful life may increase. The polishing restoration index (PRI) of Equation 2 may be from 3.10 to 3.80, for example, from 3.11 to 3.79, and for example, from 3.11 to 3.78. When the polishing restoration index (PRI) is in the above-mentioned range, the removal rate for the polished surface is excellent, and excellent effects may be obtained in terms of within-wafer nonuniformity as well.

In addition, in one embodiment, the polishing pad according to the method for refreshing of the present disclosure may have a value represented by the following Equation 3 of 0.01 to 0.22:

$$\frac{|S_{pk} - S_a|}{|S_{vk} - S_a|} \quad \text{[Equation 3]}$$

herein,

Sa is a three-dimensional arithmetic mean surface roughness Sa value,

Spk is a value for an average height of peaks protruding from the center of the surface of the polishing layer, and Svk is a value for an average height of grooves protruding downward from the center of the surface of the polishing layer.

In Equation 3, a ratio of a difference between the average height of peaks protruding from the center of the surface of the polishing layer (Spk) and the average height value on the average surface of the polishing layer and a difference between the average height of grooves protruding downward from the center of the polishing layer and the average height value on the average surface of the polishing layer is calculated, and by calculating a difference between the peak height and the groove height at the surface center with respect to average roughness of the polishing layer as a ratio, polishing performance may be predicted.

The value of Equation 3 may be from 0.01 to 0.22, for example, from 0.05 to 0.20, and for example, from 0.06 to 0.18. By the value of Equation 3 satisfying the above-mentioned range, a high level of polishing performance may be obtained by the polishing layer having surface roughness at a proper range level. Accordingly, when the value of Equation 3 satisfies the above-mentioned range, the polishing pad may be additionally used by the method for refreshing of the present disclosure, and the polishing pad having the useful life increased may exhibit superior polishing performance in the increased life range as well.

In addition, the fine concave portion of the polishing surface has the shape changed by the polishing process, and a portion of the polishing surface is subject to glazing, which resultantly may reduce polishing performance of the polishing pad. Accordingly, including the value by Equation 3 in the range of the present disclosure after supplying water vapor to the polishing pad and performing conditioning using the method for refreshing of the present disclosure means that the fine concave portion of the polishing surface is restored to its original shape, and a glazed portion of the polishing surface is reduced, which resultantly restores polishing performance.

In the polishing pad to which the method for refreshing of the present disclosure is applied, the removal rate may be from 1,500 Å/min to 1,800 Å/min and the within-wafer nonuniformity (WIWNU) may be from 8% to 9% in a process of polishing a silicon oxide film for 60 seconds while calcined ceria slurry is supplied at a rate of 200 mL/minute, a semiconductor substrate, a subject to be polished, is pressurized with a load of 3.5 psi, the polishing pad has a rotation speed of 93 rpm and the semiconductor substrate has a rotation speed of 87 rpm. The polishing pad subject to the removal rate and within-wafer nonuniformity ranges may have the useful life increased using the method for refreshing of the present disclosure, however, the present disclosure is not limited to the polishing pad, and a polishing pad having polishing performance partially reduced by a polishing process may have its polishing performance restored using the method for refreshing of the present disclosure.

The removal rate and the within-wafer nonuniformity are affected by subject film quality and slurry type, and when performing the polishing process under the condition as above, the removal rate of 1,500 Å/min to 1,800 Å/min is a low removal rate compared to a target removal rate, which means to have relatively reduced polishing efficiency, and the within-wafer nonuniformity of 8% to 9% may also mean relatively low polishing performance compared to target within-wafer nonuniformity.

The polishing pad having low polishing performance by the removal rate and the within-wafer nonuniformity as above may have the useful life increased by spraying water vapor of 50° C. to 120° C. on the polishing layer surface for 1 minute to 10 minutes, and performing conditioning as described above. The water vapor temperature may be from 50° C. to 120° C., from 60° C. to 120° C., from 70° C. to 120° C., from 50° C. to 110° C., from 60° C. to 110° C. and from 70° C. to 110° C. In the above-mentioned range, the polishing layer may have surface roughness equivalent to a new polishing pad. Using water vapor in the above-mentioned temperature range may prevent corrosion of polishing equipment and stably maintain and manage polishing equipment, however, the temperature is not limited to the above-mentioned range, and any water vapor in a temperature range capable of refreshing the polishing pad by changing surface roughness of the polishing surface may be used without being limited to the above-mentioned temperature range.

In the spraying of water vapor and the conditioning, specifically, the spraying of water vapor and the conditioning may be conducted during the time required for installing a new semiconductor substrate in a carrier after finishing the polishing process of a semiconductor substrate, a subject to be polished, while the polishing pad is installed on a surface plate.

As another method, the polishing pad is separated from a surface plate and washed using DIW, then water vapor of 50° C. to 120° C. is sprayed thereto for 1 minute to 10 minutes, and then the result may be reused after installing on a surface plate and performing conditioning.

In other words, in the method for refreshing, the method of continuously spraying water vapor and conditioning while being installed on a surface plate, and the method of firstly washing the polishing pad separated from a surface plate and secondly spraying water vapor, and then installing the result on the surface plate and conditioning may all be used.

As described above, the polishing pad may have the useful life increased in both states of being installed on a surface plate and being separated from a surface plate. When the polishing pad corresponds to any one or more of the following conditions, the useful life may increase using the method for refreshing of the present disclosure:

i) polishing pad used in polishing process
ii) polishing surface having surface roughness Sa of 6 μm or less
iii) polishing surface having surface roughness Spk of 5 μm or less
iv) polishing surface having surface roughness Svk of 16 μm or less The i) polishing pad used in a polishing process specifically has a removal rate of 1,500 Å/min to 1,800 Å/min and within-wafer nonuniformity (WIWNU) of 8% to 9% in a process of polishing a silicon oxide film for 60 seconds while calcined ceria slurry is supplied at a rate of 200 mL/minute, a semiconductor substrate, a subject to be polished, is pressurized with a load of 3.5 psi, the polishing pad has a rotation speed of 93 rpm and the semiconductor substrate has a rotation speed of 87 rpm, and may mean a polishing pad having reduced polishing efficiency due to the too low removal rate or having reduced polishing performance due to the low within-wafer nonuniformity as described above. However, the present disclosure is not limited to the polishing pad, and polishing pads with reduced polishing performance may all be used without limit.

In addition, the process of spraying water vapor and conditioning after separating from a surface plate takes additional time to separate from the surface plate and re-install thereon compared to performing a subsequent process while being installed on a surface plate, however, there is an advantage in that, by including washing using DIW, impurities and the like attached on the polishing layer surface in the polishing process may be removed.

The conditioning is conditioning the polishing layer surface at a rotation speed of 20 rpm to 150 rpm, with an applied load of 1 lb to 90 lb and at a sweep speed of 1 to 25. However, the condition is not limited thereto, and conditioning conditions that allow polishing performance to be obtained after spraying water vapor may all be used.

The polishing layer of the polishing pad gone through water vapor spraying and conditioning according to the method for refreshing of the present disclosure has a removal rate of 1,810 Å/min to 2,700 Å/min, 2,000 Å/min to 2,650 Å/min, and 2100 Å/min to 2,600 Å/min in a process of polishing a silicon oxide film for 60 seconds while calcined ceria slurry is supplied at a rate of 200 mL/minute, a semiconductor substrate, a subject to be polished, is pressurized with a load of 3.5 psi, the polishing pad has a rotation speed of 93 rpm and the semiconductor substrate has a rotation speed of 87 rpm. In addition, the within-wafer nonuniformity (WIWNU) may be from 3% to 7%, from 4% to 7%, and from 4.1% to 6.8%. As described above, it may be identified that the polishing pad has an enhanced removal rate by water vapor spraying and conditioning, and exhibits an excellent effect in within-wafer nonuniformity as well.

In one embodiment of the present disclosure, the polishing layer of the polishing pad may include a polishing layer including a cured material formed from a composition including a urethane-based prepolymer, a curing agent and a foaming agent.

Each component included in the composition will be specifically described below.

The 'prepolymer' means a polymer having a relatively low molecular weight obtained by stopping a polymerization degree in the middle so as to facilitate molding in preparing a cured material. The prepolymer may be molded to a final cured material either by itself or after reacting with other polymerizable compounds.

In one embodiment, the urethane-based prepolymer may be prepared by reacting an isocyanate compound and a polyol.

As the isocyanate compound used for preparing the urethane-based prepolymer, one selected from the group consisting of aromatic diisocyanates, aliphatic diisocyanates, alicyclic diisocyanates and combinations thereof may be used.

The isocyanate compound may include one selected from the group consisting of, for example, 2,4-toluenediisocyanate (2,4-TDI), 2,6-toluenediisocyanate (2,6-TDI) naphthalene-1,5-diisocyanate, para-phenylenediisocyanate, tolidinediisocyanate, 4,4'-diphenylmethanediisocyanate, hexamethylenediisocyanate, dicyclohexylmethanediisocyanate, isophorone diisocyanate and combinations thereof.

The 'polyol' means a compound including at least two hydroxyl groups (—OH) per molecule. The polyol may include one selected from the group consisting of, for example, polyether-based polyols, polyester-based polyols, polycarbonate-based polyols, acryl-based polyols and combinations thereof.

The polyol may include one selected from the group consisting of, for example, polytetramethylene ether glycol, polypropylene ether glycol, ethylene glycol, 1,2-propylene glycol, 1,3-propylene glycol, 1,2-butanediol, 1,3-butanediol, 2-methyl-1,3-propanediol, 1,4-butanediol, neopentyl glycol, 1,5-pentanediol, 3-methyl-1,5-pentanediol, 1,6-hexanediol, diethylene glycol, dipropylene glycol, tripropylene glycol and combinations thereof.

The polyol may have a weight average molecular weight (Mw) of about 100 g/mol to about 3,000 g/mol. The polyol may have a weight average molecular weight (Mw) of, for example, about 100 g/mol to about 3,000 g/mol, for example, about 100 g/mol to about 2,000 g/mol, and for example, about 100 g/mol to about 1,800 g/mol.

In one embodiment, the polyol may include a low molecular weight polyol having a weight average molecular weight (Mw) of about 100 g/mol or greater and less than about 300 g/mol, and a high molecular weight polyol having a weight average molecular weight (Mw) of about 300 g/mol or greater and about 1800 g/mol or less.

The urethane-based prepolymer may have a weight average molecular weight (Mw) of about 500 g/mol to about 3,000 g/mol. The urethane-based prepolymer may have a weight average molecular weight (Mw) of, for example, about 600 g/mol to about 2,000 g/mol, and for example, about 800 g/mol to about 1,000 g/mol.

In one embodiment, the isocyanate compound for preparing the urethane-based prepolymer may include an aromatic diisocyanate compound, and the aromatic diisocyanate compound may include, for example, 2,4-toluenediisocyanate (2,4-TDI) and 2,6-toluenediisocyanate (2,6-TDI). The polyol compound for preparing the urethane-based prepolymer may include polytetramethylene ether glycol (PTMEG) and diethylene glycol (DEG).

In another embodiment, the isocyanate compound for preparing the urethane-based prepolymer may include an aromatic diisocyanate compound and an alicyclic diisocyanate compound, and for example, the aromatic diisocyanate compound may include 2,4-toluenediisocyanate (2,4-TDI) and 2,6-toluenediisocyanate (2,6-TDI) and the alicyclic diisocyanate compound may include dicyclohexylmethane diisocyanate (H12MDI). The polyol compound for preparing the urethane-based prepolymer may include polytetramethylene ether glycol (PTMEG) and diethylene glycol (DEG).

The urethane-based prepolymer may have an isocyanate end group content (NCO %) of about 5% by weight to about 11% by weight, for example, about 5% by weight to about 10% by weight, for example, about 5% by weight to about 8% by weight, and for example, about 8% by weight to about 10% by weight. When having NCO % in the above-mentioned range, proper polishing layer properties are obtained in the polishing pad, and polishing performance required for a polishing process such as a polishing speed and a polishing profile may be maintained, and defects that may occur in a wafer during the polishing process may be minimized.

In addition, by controlling polishing selectivity (Ox RR/Nt RR) of an oxide film and a nitride film, dishing, recess and erosion phenomena may be prevented, and surface planarization may be achieved in a wafer.

The isocyanate end group content (NCO %) of the urethane-based prepolymer may be designed by comprehensively controlling type and content of the isocyanate compound and the polyol compound for preparing the urethane-based prepolymer, process conditions such as temperature, pressure and time of the process for preparing the urethane-based prepolymer, type and content of additives used for preparing the urethane-based prepolymer, and the like.

The curing agent is a compound for forming a final cured structure in the polishing layer by chemically reacting with the urethane-based prepolymer, and may include, for example, an amine compound or an alcohol compound. Specifically, the curing agent may include one selected from the group consisting of aromatic amines, aliphatic amines, aromatic alcohols, aliphatic alcohols and combinations thereof.

For example, the curing agent may include one selected from the group consisting of 4,4'-methylenebis(2-chloroaniline) (MOCA), diethyltoluenediamine (DETDA), diaminodiphenylmethane, dimethyl thio-toluene diamine (DMTDA), propanediol bis p-aminobenzoate, methylene bis-methylanthranilate, diaminodiphenylsulfone, m-xylylenediamine, isophoronediamine, ethylenediamine, diethylenetriamine, triethylenetetramine, polypropylenediamine, polypropylenetramine, bis(4-amino-3-chlorophenyl)methane and combinations thereof.

A content of the curing agent may be from about 18 parts by weight to about 27 parts by weight, for example, from about 19 parts by weight to about 26 parts by weight, and for example, from about 20 parts by weight to about 26 parts by weight based on 100 parts by weight of the urethane-based prepolymer. The curing agent content satisfying the above-mentioned range may be more advantageous in obtaining target performance of the polishing pad.

The foaming agent is a component for forming a pore structure in the polishing layer, and may include one selected from the group consisting of a solid-state foaming agent, a gas-state foaming agent, a liquid-state foaming agent and combinations thereof. In one embodiment, the foaming agent may include a solid-state foaming agent, a gas-state foaming agent or a combination thereof.

The solid-state foaming agent may have an average particle diameter of about 5 μm to about 200 μm, for example, about 20 μm to about 50 μm, for example, about 21 μm to about 50 μm, and for example, about 25 μm to about 45 μm. When the solid-state foaming agent is thermally expanded particles to describe later, the average particle diameter of the solid-state foaming agent may mean an average particle diameter of the thermally expanded particles themselves, and when the solid-state foaming agent is unexpanded particles to describe later, the average particle diameter of the solid-state foaming agent may mean an average particle diameter of particles after being expanded by heat or pressure.

The solid-state foaming agent may include expandable particles. The expandable particles are particles having a property of being expandable by heat, pressure or the like, and final sizes in the polishing layer may be determined by heat, pressure or the like applied during the process for preparing the polishing layer. The expandable particles may include thermally expanded particles, unexpanded particles or a combination thereof. The thermally expanded particles are particles pre-expanded by heat, and mean particles having little or no changes in the size by heat or pressure applied during the process for preparing the polishing layer. The unexpanded particles are particles not pre-expanded, and mean particles having the final size determined after being expanded by heat or pressure applied during the process for preparing the polishing layer.

The expandable particles may include an outer cover made of resin; and an expansion-inducing component present on the inside sealed by the outer cover.

For example, the outer cover may include a thermoplastic resin, and the thermoplastic resin may be one or more types selected from the group consisting of vinylidene chloride-based copolymers, acrylonitrile-based copolymers, methacrylonitrile-based copolymers and acryl-based copolymers.

The expansion-inducing component may include one selected from the group consisting of hydrocarbon compounds, chlorofluoro compounds, tetraalkylsilane compounds and combinations thereof.

Specifically, the hydrocarbon compound may include one selected from the group consisting of ethane, ethylene, propane, propene, n-butane, isobutene, n-butene, isobutene, n-pentane, isopentane, neopentane, n-hexane, heptane, petroleum ether and combinations thereof.

The chlorofluoro compound may include one selected from the group consisting of trichlorofluoromethane ($CCl_3F$), dichlorodifluoromethane ($CCl_2F_2$), chlorotrifluoromethane ($CCFl_3$), tetratluoroethylene ($CClF_2$—$CClF_2$) and combinations thereof.

The tetraalkylsilane compound may include one selected from the group consisting of tetramethylsilane, trimethylethylsilane, trimethylisopropylsilane, trimethyl-n-propylsilane and combinations thereof.

The solid-state foaming agent may optionally include inorganic component-treated particles. For example, the solid-state foaming agent may include inorganic component-treated expandable particles. In one embodiment, the solid-state foaming agent may include silica ($SiO_2$) particle-treated expandable particles. Treating the solid-state foaming agent with an inorganic component may prevent aggregation between the plurality of particles. The inorganic component-treated solid-state foaming agent may have different chemical, electrical and/or physical properties of the foaming agent surface from the solid-state foaming agent not treated with an inorganic component.

The solid-state foaming agent may have a content of about 0.5 parts by weight to about 10 parts by weight, for example, about 1 part by weight to about 3 parts by weight, for example, about 1.3 parts by weight to about 2.7 parts by weight, and for example, about 1.3 parts by weight to about 2.6 parts by weight based on 100 parts by weight of the urethane-based prepolymer.

Type and content of the solid-state foaming agent may be designed depending on target pore structure and properties of the polishing layer.

The gas-state foaming agent may include an inert gas. The gas-state foaming agent may be introduced during a reaction between the urethane-based prepolymer and the curing agent, and used as a pore-forming element.

The inert gas is not particularly limited in the type as long as it is a gas that does not participate in the reaction between the urethane-based prepolymer and the curing agent. For example, the inert gas may include one selected from the group consisting of nitrogen gas ($N_2$), argon gas (Ar), helium gas (He) and combinations thereof. Specifically, the inert gas may include nitrogen gas ($N_2$) or argon gas (Ar).

Type and content of the gas-state foaming agent may be designed depending on target pore structure and properties of the polishing layer.

In one embodiment, the foaming agent may include a solid-state foaming agent. For example, the foaming agent may be formed only with a solid-state foaming agent.

The solid-state foaming agent includes expandable particles, and the expandable particles may include thermally expanded particles. For example, the solid-state foaming agent may be formed only with thermally expanded particles. When the solid-state foaming agent is formed only with thermally expanded particles without including the unexpanded particles, variability of the pore structure is reduced, however, predictability increases, which is advantageous in obtaining uniform pore properties over the entire area of the polishing layer.

In one embodiment, the thermally expanded particles may be particles having an average particle diameter of about 5 μm to about 200 μm. The thermally expanded particles may have an average particle diameter of about 5 μm to about 100 μm, for example, about 10 μm to about 80 μm, for example, about 20 μm to about 70 μm, for example, about 20 μm to about 50 μm, for example, about 30 μm to about 70 μm, for example, about 25 μm to 45 μm, for example, about 40 μm to about 70 μm, and for example, about 40 μm to about 60 μm. The average particle diameter may be defined as D50 of the thermally expanded particles.

In one embodiment, the thermally expanded particles may have density of about 30 $kg/m^3$ to about 80 $kg/m^3$, for example, about 35 $kg/m^3$ to about 80 $kg/m^3$, for example, about 35 $kg/m^3$ to about 75 $kg/m^3$, for example, about 38 $kg/m^3$ to about 72 $kg/m^3$, for example, about 40 $kg/m^3$ to about 75 $kg/m^3$, and for example, about 40 $kg/m^3$ to about 72 $kg/m^3$.

In one embodiment, the foaming agent may include a gas-state foaming agent. For example, the foaming agent may include a solid-state foaming agent and a gas-state foaming agent. Descriptions on the solid-state foaming agent are the same as the descriptions provided above.

The gas-state foaming agent may include nitrogen gas.

The gas-state foaming agent may be injected through a predetermined injection line during the process of mixing the urethane-based prepolymer, the solid-state foaming agent and the curing agent. The gas-state foaming agent may have an injection rate of about 0.8 L/min to about 2.0 L/min, for example, about 0.8 L/min to about 1.8 L/min, for example, about 0.8 L/min to about 1.7 L/min, for example, about 1.0 L/min to about 2.0 L/min, for example, about 1.0 L/min to about 1.8 L/min, and for example, about 1.0 L/min to about 1.7 L/min.

The composition for preparing the polishing layer may further include other additives such as a surfactant and a reaction rate control agent. The names such as 'surfactant' and 'reaction rate control agent' are arbitrary names based on the main role of the corresponding materials, and each of the corresponding materials does not necessarily perform only the function limited to the role given by the corresponding name.

The surfactant is not particularly limited as long as it is a material performing a role of preventing a phenomenon such as aggregation or overlapping of pores. For example, the surfactant may include a silicone-based surfactant.

The surfactant may be used in a content of about 0.2 parts by weight to about 2 parts by weight based on 100 parts by weight of the urethane-based prepolymer. Specifically, the surfactant may be included in a content of about 0.2 parts by weight to about 1.9 parts by weight, for example, about 0.2 parts by weight to about 1.8 parts by weight, for example, about 0.2 parts by weight to about 1.7 parts by weight, for example, about 0.2 parts by weight to about 1.6 parts by weight, for example, about 0.2 parts by weight to about 1.5 parts by weight, and for example, about 0.5 parts by weight to 1.5 parts by weight based on 100 parts by weight of the urethane-based prepolymer. When including the surfactant in an amount within the above-mentioned range, pores derived from the gas-state foaming agent may be stably formed and maintained in the mold.

The reaction rate control agent performs a role of accelerating or delaying a reaction, and depending on the purpose, a reaction accelerator, a reaction retarder or both may be used. The reaction rate control agent may include a reaction accelerator. For example, the reaction accelerator may be one or more types of reaction accelerators selected from the group consisting of tertiary amine-based compounds and organometal-based compounds.

Specifically, the reaction rate control agent may include one or more types selected from the group consisting of triethylenediamine, dimethylethanolamine, tetramethylbutanediamine, 2-methyl-triethylenediamine, dimethylcyclohexylamine, triethylamine, triisopropanolamine, 1,4-diazabicyclo(2,2,2)octane, bis(2-methylaminoethyl)ether, trimethylaminoethylethanolamine, N,N,N,N,N"-pentamethyldiethylenetriamine, dimethylaminoethylamine, dimethylaminopropylamine, benzyldimethylamine, N-ethylmorpholine, N,N-dimethylaminoethylmorpholine, N,N-dimethylcyclohexylamine, 2-methyl-2-azanorbornane, dibutyl tin dilaurate, stannous octoate, dibutyl tin diacetate, dioctyl tin diacetate, dibutyl tin maleate, dibutyl tin di-2-ethylhexanoate and dibutyl tin dimercaptide. Specifically, the reaction rate control agent may include one or more types selected from the group consisting of benzyldimethylamine, N,N-dimethylcyclohexylamine and triethylamine.

The reaction rate control agent may be used in an amount of about 0.05 parts by weight to about 2 parts by weight based on 100 parts by weight of the urethane-based prepolymer. Specifically, the reaction rate control agent may be used in an amount of about 0.05 parts by weight to about 1.8 parts by weight, for example, about 0.05 parts by weight to about 1.7 parts by weight, for example, about 0.05 parts by weight to about 1.6 parts by weight, for example, about 0.1 parts by weight to about 1.5 parts by weight, for example, about 0.1 parts by weight to about 0.3 parts by weight, for example, about 0.2 parts by weight to about 1.8 parts by weight, for example, about 0.2 parts by weight to about 1.7 parts by weight, for example, about 0.2 parts by weight to about 1.6 parts by weight, for example, about 0.2 parts by weight to about 1.5 parts by weight, and for example, about 0.5 parts by weight to about 1 part by weight based on 100 parts by weight of the urethane-based prepolymer. When the reaction rate control agent is used in the content range described above, a polishing layer having desired pore size and hardness may be formed by properly controlling the curing reaction rate of the prepolymer composition.

When the polishing pad includes a cushion layer, the cushion layer performs a role of, while supporting the polishing layer, absorbing and dispersing an external impact applied to the polishing layer, thereby minimizing occurrences of damages and defects for a subject to be polished during the polishing process using the polishing pad.

The cushion layer may include a non-woven fabric or suede, but is not limited thereto.

In one embodiment, the cushion layer may be a resin-impregnated non-woven fabric. The non-woven fabric may be a fibrous non-woven fabric including one selected from the group consisting of polyester fibers, polyamide fibers, polypropylene fibers, polyethylene fibers and combinations thereof.

The resin impregnated into the non-woven fabric may include one selected from the group consisting of a polyurethane resin, a polybutadiene resin, a styrene-butadiene copolymer resin, a styrene-butadiene-styrene copolymer resin, an acrylonitrile-butadiene copolymer resin, a styrene-ethylene-butadiene-styrene copolymer resin, a silicone rubber resin, a polyester-based elastomer resin, a polyamide-based elastomer resin and combinations thereof.

Hereinafter, a method for manufacturing the polishing pad will be described in detail.

Another embodiment according to the present disclosure may provide a method for manufacturing the polishing pad, the method including preparing a prepolymer composition; preparing a composition for preparing a polishing layer including the prepolymer composition, a foaming agent and a curing agent; and preparing a polishing layer by curing the composition for preparing a polishing layer.

The preparing of a prepolymer composition may be a process of preparing a urethane-based prepolymer by reacting a diisocyanate compound and a polyol compound. Descriptions on the diisocyanate compound and the polyol compound are the same as the descriptions provided above regarding the polishing pad.

The isocyanate group (NCO group) of the prepolymer composition may be included in a content of about 5% by weight to about 15% by weight, for example, about 5% by weight to about 8% by weight, for example, about 5% by weight to about 7% by weight, for example, about 8% by weight to about 15% by weight, for example, about 8% by weight to about 14% by weight, for example, about 8% by weight to about 12% by weight, and for example, about 8% by weight to about 10% by weight.

The isocyanate group content of the prepolymer composition may be derived from the isocyanate end group of the urethane-based prepolymer, an unreacted isocyanate group of the diisocyanate compound or the like.

The prepolymer composition may have viscosity of about 100 cps to about 1,000 cps, for example, about 200 cps to about 800 cps, for example, about 200 cps to about 600 cps, for example, about 200 cps to about 550 cps, and for example, about 300 cps to about 500 cps at about 80° C.

The foaming agent may include a solid-state foaming agent or a gas-state foaming agent.

When the foaming agent includes a solid-state foaming agent, the preparing of a composition for preparing a polishing layer may include preparing a first preliminary composition by mixing the prepolymer composition and the solid-state foaming agent; and preparing a second preliminary composition by mixing the first preliminary composition and a curing agent.

The first preliminary composition may have viscosity of about 1,000 cps to about 2,000 cps, for example, about 1,000 cps to about 1,800 cps, for example, about 1,000 cps to about 1,600 cps, and for example, about 1,000 cps to about 1,500 cps at about 80° C.

When the foaming agent includes a gas-state foaming agent, the preparing of a composition for preparing a polishing layer may include preparing a third preliminary composition including the prepolymer composition and the curing agent; and preparing a fourth preliminary composition by injecting the gas-state foaming agent to the third preliminary composition.

In one embodiment, the third preliminary composition may further include a solid-state foaming agent.

In one embodiment, the process for preparing a polishing layer may include preparing a mold preheated to a first temperature; and injecting the composition for preparing a polishing layer to the preheated mold for curing; and post-curing the cured composition for preparing a polishing layer under a second temperature condition.

In one embodiment, the first temperature is from about 50° C. to about 150° C., preferably from about 90° C. to about 140° C., and more preferably from about 90° C. to about 120° C.

In one embodiment, the second temperature may be from about 100° C. to about 130° C., for example, from about 100° C. to 125° C., and for example, from about 100° C. to about 120° C.

The curing of the composition for preparing a polishing layer at the first temperature may be conducted for about 5 minutes to about 60 minutes, for example, for about 5 minutes to about 40 minutes, for example, for about 5 minutes to about 30 minutes, and for example, for about 5 minutes to about 25 minutes.

The post-curing of the composition for preparing a polishing layer, which is cured under the first temperature, under the second temperature may be conducted for about 5 hours to about 30 hours, for example, for about 5 hours to about 25 hours, for example, for about 10 hours to about 30 hours, for example, for about 10 hours to about 25 hours, for example, for about 12 hours to about 24, and for example, for about 15 hours to about 24 hours.

The method for manufacturing the polishing pad may include processing at least one surface of the polishing layer.

The processing of at least one surface of the polishing layer may include at least one of forming a groove on at least one surface of the polishing layer (1); line turning at least one surface of the polishing layer (2); and roughening at least one surface of the polishing layer (3).

In the step (1), the groove may include at least one of a concentric circular groove formed spaced apart from the center of the polishing layer at a predetermined interval; and a radial groove continuously connected from the center of the polishing layer to the edge of the polishing layer.

In the step (2), the line turning may be conducted using a method of cutting the polishing layer by a predetermined thickness using a cutting tool.

In the step (3), the roughening may be conducted using a method of processing the surface of the polishing layer using a sanding roller.

The method for manufacturing the polishing pad may further include laminating a cushion layer on the rear surface of the polishing surface of the polishing layer.

The polishing layer and the cushion layer may be laminated through a heat melt adhesive.

The heat melt adhesive is coated on the rear surface of the polishing surface of the polishing layer and the heat melt adhesive is coated on the surface to be in contact with the polishing layer of the cushion layer, and, after laminating the polishing layer and the cushion layer so that the surfaces each coated with the heat melt adhesive are in contact with each other, the two layers may be fused using a pressure roller.

In addition, another embodiment may provide a method for manufacturing a semiconductor device, the method including bonding a polishing pad, which includes a polishing surface and a surface plate-attaching surface on the rear surface of the polishing surface, on a surface plate; arranging a surface to be polished of a subject to be polished to be in contact with the polishing surface, and then polishing the subject to be polished while rotating the polishing pad and the subject to be polished relative to each other under a pressurized condition; identifying the progress of the actual polishing process in a target polishing time range in the polishing; and, when the time of the progress of the actual polishing process is not included in the target polishing time range, spraying water vapor of 50° C. to 120° C. to the polishing layer surface of the polishing pad, and conditioning.

The identifying of the progress of the actual polishing process may be conducted by, when the time required in the polishing process for the subject to be polished is included in the target polishing time range, replacing the subject to be polished and repeating the polishing process. However, the polishing pad failing to fall within the target polishing time range may have the useful life increased by the spraying of water vapor and the conditioning. After the water vapor spraying and the conditioning, the polishing layer of the polishing pad may have a polishing restoration index (PRI) represented by the following Equation 2 of 3.10 to 3.80:

$$PRI = \frac{(S_{pk} + S_{vk})}{S_a} \quad \text{[Equation 2]}$$

herein,

Sa is a three-dimensional arithmetic mean surface roughness Sa value,

Spk is a value for an average height of peaks protruding from the center of the surface of the polishing layer, and Svk is a value for an average height of grooves protruding downward from the center of the surface of the polishing layer.

FIGS. 6 and 7 illustrate schematic flowcharts of the process for manufacturing a semiconductor device according to one embodiment. Referring to FIG. 6, the polishing pad 100 according to one embodiment is installed on a surface plate 200, and then a semiconductor substrate 500, a subject to be polished, may be disposed on the polishing pad 100. Herein, the surface to be polished of the semiconductor substrate 500 may be in direct contact with the polishing surface of the polishing pad 100. For the polishing, polishing slurry 310 may be sprayed on the polishing pad through a nozzle 300. A flow rate of the polishing slurry 310 supplied through the nozzle 300 may be selected depending on the purpose within a range of about 10 $cm^3$/minute to about 1,000 $cm^3$/minute, and for example, about 50 $cm^3$/minute to about 500 $cm^3$/minute, however, the flow rate is not limited thereto.

After that, the semiconductor substrate 500 and the polishing pad 100 may rotate relative to each other to polish the surface of the semiconductor substrate 500. Herein, the rotation direction of the semiconductor substrate 500 and the rotation direction of the polishing pad 100 may be the same direction or may be the opposite direction. The rotation speeds of the semiconductor substrate 500 and the polishing pad 100 may each be selected depending on the purpose in a range of about 10 rpm to about 500 rpm, and for example, about 30 rpm to about 200 rpm, however, the rotation speeds are not limited thereto.

The semiconductor substrate 500 is pressurized with a predetermined load to be brought into contact with the polishing surface of the polishing pad 100 while being installed on the polishing head 400, and the surface may be polished. The weight applied to the surface of the semiconductor substrate 500 and the polishing surface of the polishing pad 100 by the polishing head 400 may be selected depending on the purpose in a range of about 1 gf/$cm^2$ to about 1,000 gf/$cm^2$, and for example, about 10 gf/$cm^2$ to about 800 gf/$cm^2$, however, the weight is not limited thereto.

In one embodiment, the method for manufacturing a semiconductor device may further include, in order to maintain the polishing surface of the polishing pad 100 in a state suitable for polishing, processing the polishing surface of the polishing pad 100 through a conditioner 600 simultaneously with the polishing of the semiconductor substrate 500.

FIG. 7 relates to the method for manufacturing a semiconductor device in one embodiment of the present disclosure, and specifically, (a) is a step of installing a polishing pad 100 on a surface plate 200, and (b) is a step of injecting slurry 310 by a nozzle 300 and performing a polishing process while a semiconductor substrate 500 is in contact with the polishing pad 100. A step (c) after that is, in the identifying of the progress of the actual polishing process as described above, spraying water vapor 710 to the polishing pad 100, in which the time taken in the polishing process for the subject to be polished is not included in the target polishing time range, through a water vapor spray unit 700. Specifically, the step (c) may use the water vapor spray unit 700 as illustrated in the drawing, however, the water vapor spray unit is not limited thereto, and any spray unit 700 capable of evenly spraying water vapor of 50° C. to 110° C. to the polishing layer in the polishing pad may be used without limit.

After the step (c), a step (d) is conditioning by a conditioner 600. By the steps (c) and (d), the polishing pad 100 may have polishing performance for the semiconductor substrate 500 restored to a level usable in the polishing process again, and a useful life of the polishing pad 100 may increase.

An apparatus for manufacturing a semiconductor device according to another embodiment of the present disclosure includes a surface plate 200 on which a polishing pad is installed; a carrier 400 in which a semiconductor substrate is installed; and a water vapor spray unit 700, wherein the water vapor spray unit 700 may supply water vapor to the polishing pad 100 installed on the surface plate 200.

The apparatus for manufacturing a semiconductor device may include a nozzle unit 300, a conditioner 600 and the like in addition to the surface plate 200, the carrier 400 and the water vapor spray unit 700. The apparatus for manufacturing a semiconductor device is used for manufacturing a semiconductor device, and is characterized by including the water vapor spray unit 700.

The water vapor spray unit 700 is a constitution for supplying water vapor 710 to the polishing pad 100, and more specifically, may restore polishing performance by supplying water vapor 710 to the polishing surface of the polishing pad 100.

The water vapor spray unit 700 may be used in both a state of the polishing pad 100 being installed on the surface plate 200 and a state of being detached from the surface plate 200. The water vapor spray unit 700 may be a type in which heated water vapor 710 is supplied from the outside and supplied through the water vapor spray unit 700 or a type in which water supplied to the water vapor spray unit 700 is prepared as water vapor 710 by applying heat internally and supplied, however, the type is not limited to the examples, and methods capable of supplying water vapor 710 to the polishing pad 100 may all be used.

In addition, the surface plate 200, the carrier 400, the nozzle unit 300 and the conditioner 600 are the same as those used in a common apparatus for manufacturing a semiconductor device, and are not limited in the constitutions.

Hereinafter, specific examples of the present disclosure will be provided. However, the examples described below are only for specifically illustrating or describing the present disclosure, and the present disclosure is not limited thereto.

Preparation Example: Manufacture of Polishing Pad

A diisocyanate component and a polyol component were mixed and introduced to a four-neck flask, and the mixture was reacted at 80° C. to prepare a preliminary composition including a urethane-based prepolymer. Herein, the mixture was reacted so that the preliminary composition has an isocyanate group content (NCO %) of 9% by weight. As the diisocyanate component, an aromatic diisocyanate and an alicyclic diisocyanate were used, and 2,4-TDI and 2,6-TDI were used as the aromatic diisocyanate and $H_{12}$MDI was used as the alicyclic diisocyanate. The 2,6-TDI was used in 25 parts by weight with respect to 100 parts by weight of the 2,4-TDI, and the $H_{12}$MDI was used in 11 parts by weight with respect to a total 100 parts by weight of the aromatic diisocyanate. As the polyol component, PTMG and DEG were used, and with respect to a total 100 parts by weight of the diisocyanate component, the PTMG was used in 129 parts by weight and the DEG was used in 14 parts by weight. As a curing agent, 4,4'-methylenebis(2-chloroaniline) (MOCA) was used, and mixed so that the amine group ($NH_2$) in the curing agent has a molar ratio of 0.96 with respect to the isocyanate group (NCO group). Subsequently, a solid-state foaming agent (Akzonobel N.V) was mixed in 1.0 parts by weight with respect to 100 parts by weight of the preliminary composition. The preliminary composition was injected into a mold, which has a width of 1,000 mm, a length of 1,000 mm and a height of 3 mm and is preheated to 90° C., at a discharge rate of 10 kg/min, and at the same time, nitrogen ($N_2$) gas was injected at an injection rate of 1.0 L/min as a gas-state foaming agent. Then, the preliminary composition was subject to a post-curing reaction under a temperature condition of 110° C., and after going through groove formation and line turning processing, a polishing layer having a thickness of 20 mm was prepared.

A cushion layer having a thickness of 10 mm in which a urethane-based resin is impregnated into a polyester resin non-woven fabric was prepared, a heat melt adhesive was coated on one surface of the polishing layer and a heat melt agent was also coated on one surface of the cushion layer, and the result was laminated using a pressure roller so that each adhesive-coated surface is in contact with each other. Subsequently, a pressure-sensitive adhesive was coated on the other surface of the cushion layer, and then dried to prepare an adhesive layer for attaching on a surface plate.

Examples 1 to 8

After repeating the polishing process using the polishing pad, the polishing pads having an actual polishing time greater than the target polishing time range were used as Examples 1 to 8.

In Examples 1 to 4, the used polishing pad was separated from the surface plate and washed for 1 minute using DIW, and after spraying water vapor on the surface of the polishing layer, the result was conditioned, and then attached to the surface plate again (exsitu).

In Examples 5 to 8, water vapor was sprayed on the polishing layer surface while being installed on the surface plate, and the result was conditioned (insitu).

Comparative Example 1

A new polishing pad manufactured according to the preparation example was used in the polishing process.

Comparative Example 2

After repeating the polishing process using the polishing pad, the polishing pad having an actual polishing time greater than the target polishing time range was used.

Experimental Example 1: Measurement of Surface Roughness and 3D Image

In order to measure surface roughness for the polishing layer of the polishing pad before and after the polishing process, the surface roughness was measured using a non-contact 3D optical profiler (Contour GT manufactured by Bruker Corporation).

Based on the value of Comparative Example 2, the rate of change (%) in the Sa for the polishing surface before and after the supply of water vapor was calculated by the following Equation 1:

$$(Sa_r - Sa_f)/Sa_f \times 100 \quad \text{[Equation 1]}$$

herein, $Sa_f$ is surface roughness (Sa) of the polishing surface before supplying water vapor to the polishing pad, and $Sa_r$ is surface roughness (Sa) of the polishing surface after supplying water vapor to the polishing pad.

The rate of change (%) in Svk was calculated using the following Equation 4:

$$(Svk_r - Svk_f)/Svk_f \times 100 \quad \text{[Equation 4]}$$

herein, $Svk_f$ is surface roughness (Svk) of the polishing surface before supplying water vapor to the polishing pad, and $Svk_r$ is surface roughness (Svk) of the polishing surface after supplying water vapor to the polishing pad.

According to the surface roughness measurement results, values of the following Equations 2 and 3 were derived:

$$PRI = \frac{(S_{pk} + S_{vk})}{S_a} \quad \text{[Equation 2]}$$

$$\frac{|S_{pk} - S_a|}{|S_{vk} - S_a|} \quad \text{[Equation 3]}$$

herein,

Sa is a three-dimensional arithmetic mean surface roughness Sa value,

Spk is a value for an average height of peaks protruding from the center of the surface of the polishing layer, and Svk is a value for an average height of grooves protruding downward from the center of the surface of the polishing layer.

Experimental Example 2: Measurement of SEM Image

Surface SEM images for the polishing layer of the polishing pad before and after the polishing process were measured. The surface was magnified 100 times to measure the SEM images.

Experimental Example 3: Evaluation on Polishing Performance

The polishing pad was attached to a CMP equipment, and a silicon wafer (PETEOS) was installed so that the oxide layer faces toward the polishing surface of the polishing pad. The oxide film was polished for 60 seconds under a condition in which calcined ceria slurry was supplied on the polishing pad at a rate of 200 mL/minute, a carrier had a load of 3.5 psi, a head speed was 87 rpm and a surface plate rotation speed was 93 rpm.

After the polishing, the silicon wafer was removed from the carrier and installed in a spin dryer, and, after washing with purified water (DIW), dried with nitrogen for 15 seconds. For the dried silicon wafer, a change in the film thicknesses before and after the polishing was measured using a spectral interference thickness measurement device (manufacturer: Keyence Corporation, model name: SI-F80R). After that, a removal rate was calculated using the following Mathematical Equation 1.

Removal rate=Polished thickness of silicon wafer (Å)/polishing time (60 seconds) [Mathematical Equation 1]

The removal rate was measured by measuring the wafer thickness before and after the polishing process, and the measurements were made at 48 to 100 points in a straight line on the wafer. All sites other than 1 mm to 3 mm from the cross-sectional site were decided as measured values, and by parameterizing the measured values, an average of the measured values was employed as a removal rate (RR, Å/min), and WIWNU (within-wafer nonuniformity) was calculated by (standard deviation/average)×100(%).

Experimental Example 4: Evaluation on Properties of Polishing Layer (1) Hardness For each of the polishing pads manufactured according to the examples and the comparative examples, Shore D hardness was measured, and the polishing pad was cut to a size of 2 cmx 2 cm (thickness: 2 mm), and left still for 16 hours under an environment of a temperature of 25° C. and humidity of 50*5%. After that, hardness of the polishing pad was measured using a hardness tester (D-type hardness tester).

(2) Tensile

For each of the polishing pads manufactured according to the examples and the comparative examples, a highest strength value immediately before fracture was obtained while testing at a speed of 500 mm/minute using a universal testing machine (UTM), and through the obtained value, a slope in the region of 20% to 70% of the strain-stress curve was calculated.

(3) Elongation

For each of the polishing pads manufactured according to the examples and the comparative examples, a maximum deformation amount immediately before fracture was obtained while testing at a speed of 500 mm/minute using a universal testing machine (UTM), and a ratio of the maximum deformation amount with respect to the initial length was expressed as a percentage (%).

(4) Elastic Modulus

For each of the polishing pads manufactured according to the examples and the comparative examples, a highest strength value immediately before fracture was obtained while testing at a speed of 500 mm/minute using a universal testing machine (UTM), and through the obtained value, a slope in the region of 20% to 70% of the strain-stress curve was calculated.

The results of Experimental Examples 1 to 4 are as shown in the following Table 1.

TABLE 1

| Description | | | Example 1 | Example 2 | Example 3 | Example 4 | Example 5 |
|---|---|---|---|---|---|---|---|
| Additional Description | | | Recover used pad by exsitu | | | | Recover used pad by insitu |
| Before heat treatment | Properties | Hardness (Shoer D) | 60 | 60.2 | 58.9 | 60.3 | 59.7 |
| | | Tensile ($N/mm^2$) | 23.43 | 22.52 | 23.04 | 23.17 | 22.87 |
| | | Elongation (%) | 128.476 | 123.274 | 120.734 | 116.488 | 122.797 |
| | Roughness | Sa (μm) | 4.054 | 4.147 | 4.073 | 4.414 | 4.51 |
| | | Spk (μm) | 2.145 | 2.421 | 2.154 | 1.959 | 1.141 |
| | | Svk (μm) | 13.32 | 13.44 | 13.54 | 14.51 | 12.42 |
| | Evaluation | Polishing time (second) | | | 60 | | |
| | | RR (Å/min) | 1721 | 1754 | 1747 | 1695 | 1684 |
| | | WIWNU (%) | 8.40 | 8.50 | 8.70 | 8.30 | 8.80 |
| Heat treatment | Condition | Platen speed (rpm) | 93 | 93 | 93 | 93 | 93 |
| | | DIW | After washing for 1 minute | | | | Insitu |
| | | Temperature | 50 | 70 | 90 | 110 | 50 |
| | | Time | 5 Minutes | 5 Minutes | 5 Minutes | 5 Minutes | Last |
| | | Equipment | Steam Spray | Steam Spray | Steam Spray | Steam Spray | Steam Spray |
| | | Conditioner | CI-45 | CI-45 | CI-45 | CI-45 | CI-45 |
| | | D/D | 6 lb | 6 lb | 6 lb | 6 lb | 6 lb |
| | | Disk speed | 101 | 101 | 101 | 101 | 101 |
| | | Disk sweep speed (sw/min) | 19 | 19 | 19 | 19 | 19 |
| After heat treatment | Properties | Hardness (Shoer D) | 59.8 | 60.1 | 54.4 | 60.1 | 59.8 |
| | | Tensile ($N/mm^2$) | 23.85 | 23.24 | 22.59 | 22.94 | 22.87 |
| | | Elongation (%) | 123.187 | 119.007 | 116.006 | 118.297 | 114.282 |
| | Roughness | Sa (μm) | 5.313 | 6.44 | 6.803 | 6.328 | 5.326 |
| | | Spk (μm) | 2.545 | 5.027 | 5.956 | 5.509 | 2.812 |
| | | Svk (μm) | 13.393 | 17.521 | 19.112 | 17.445 | 13.649 |
| | | Value of Equation 2 | 3.00 | 3.50 | 3.68 | 3.63 | 3.09 |
| | | Value of Equation 3 | 0.24 | 0.25 | 0.25 | 0.23 | 0.26 |
| | | Rate of Change in Sa (value of Equation 1, %) | 31.06 | 55.29 | 67.03 | 43.36 | 18.09 |
| | | Rate of change in Svk (value of Equation 4, %) | 0.55 | 30.36 | 41.15 | 20.23 | 9.90 |

TABLE 1-continued

| | | | | | | | |
|---|---|---|---|---|---|---|---|
| | | Polishing time (Second) | | | 60 | | |
| | | RR (Å/min) | 1815 | 2187 | 2337 | 2092 | 2010 |
| | | WIWNU (%) | 8.2 | 6.7 | 4.5 | 6.1 | 8.5 |
| | | Polishing rate (%) with respect to new pad | 72 | 87 | 93 | 83 | 80 |

| Description Additional Description | | | Example 6 | Example 7 | Example 8 | Comparative Example 1 Pad Comparative Group 1 | Comparative Example 2 Used pad* Comparative Group 2 |
|---|---|---|---|---|---|---|---|
| | | | Recover used pad by insitu | | | | |
| Before heat treatment | Properties | Hardness (Shoer D) | 59.6 | 59.6 | 59.2 | 60.2 | 58.8 |
| | | Tensile ($N/mm^2$) | 23.08 | 23.56 | 22.54 | 22.59 | 22.45 |
| | | Elongation (%) | 116.16 | 117.067 | 109.664 | | |
| | Roughness | Sa (μm) | 4.025 | 4.331 | 4.315 | 6.547 | 4.074 |
| | | Spk (μm) | 1.542 | 2.541 | 2.477 | 5.53 | 1.839 |
| | | Svk (μm) | 13.57 | 13.37 | 11.57 | 14.85 | 13.84 |
| | Evaluation | Polishing time (second) | | | 60 | | |
| | | RR (Å/min) | 1657 | 1694 | 1715 | 2521 | 1741 |
| | | WIWNU (%) | 8.70 | 8.50 | 8.20 | 4.60 | 8.80 |
| Heat treatment | Condition | Platen speed (rpm) | 93 | 93 | 93 | | |
| | | DIW | | Insitu | | | |
| | | Temperature | 70 | 90 | 110 | | |
| | | Time | Last | Last | Last | | |
| | | Equipment | Steam Spray | Steam Spray | Steam Spray | | |
| | | Conditioner | CI-45 | CI-45 | CI-45 | | |
| | | D/D | 6 lb | 6 lb | 6 lb | | |
| | | Disk speed | 101 | 101 | 101 | | |
| | | Disk sweep speed (sw/min) | 19 | 19 | 19 | | |
| After heat treatment | Properties | Hardness (Shoer D) | 59.7 | 59.8 | 59.9 | | |
| | | Tensile ($N/mm^2$) | 23.01 | 23.18 | 22.12 | | |
| | | Elongation (%) | 114.758 | 117.965 | 112.506 | | |
| | Roughness | Sa (μm) | 6.169 | 6.42 | 6.674 | | |
| | | Spk (μm) | 4.847 | 5.279 | 5.128 | | |
| | | Svk (μm) | 16.231 | 18.958 | 16.215 | | |
| | | Value of Equation 2 | 3.42 | 3.78 | 3.20 | 3.11 | 3.85 |
| | | Value of Equation 3 | 0.29 | 0.27 | 1.32 | 0.12 | 0.23 |
| | | Rate of Change in Sa (value of Equation 1, %) | 53.27 | 48.23 | 54.67 | | |
| | | Rate of change in Svk (value of Equation 4, %) | 19.61 | 41.80 | 40.15 | | |
| | | Polishing time (Second) | | | 60 | | |
| | | RR (Å/min) | 2480 | 2534 | 2544 | | |
| | | WIWNU (%) | 5.8 | 4.6 | 5.8 | | |

TABLE 1-continued

| | | | | | |
|---|---|---|---|---|---|
| Polishing rate (%) with respect to new pad | 98 | 101 | 101 | 100 | 69 |

(*Used pad may mean failing to reach target removal rate or target within-wafer nonuniformity due to the use in polishing process.)

From the property evaluation by Experimental Example 4, it may be identified that the same values are obtained in the examples and the comparative examples before and after the heat treatment. This means that heat treatment does not affect properties of the polishing layer of the polishing pad.

The results of measuring surface roughness by Experimental Example 1 are as shown in Table 1, and FIGS. 8 and 9. FIG. 8 is a result of photographing a 3D image for the polishing layer of the used polishing pad after the use is completed (Comparative Example 2), and FIG. 9 is a result of photographing a 3D image for the polishing pad reusable by heat treatment as in Examples 1 to 8. As shown in the drawings, the polishing pad to be discarded evenly exhibits the height of red color in the degree of surface roughness, and it may be identified that the degree of roughness is formed gently. The polishing layer as above has a low removal rate when used in a polishing process, and has a problem of reducing polishing efficiency.

On the other hand, it may be identified that surface roughness is restored in the examples as in FIG. 9, which is identifiable through the numbers of Table 1. Specifically, it was identified that the Sa was in the range of 5 μm to 7 μm, Spk in the range of 2 μm to 6 μm, and Svk in the range of 12 μm to 20 μm. The measured values are relatively high compared to the values of the polishing pad of Comparative Example 2, and a difference appearing in the surface roughness may be identified.

Regarding the surface roughness measurement results, the state of the polishing layer was more clearly identified through the SEM images in Experimental Example 2. FIGS. 10 and 12 are SEM images for the polishing layer in the polishing pad of Comparative Example 2, wherein FIG. 10 is an image magnified by a factor of 100 and FIG. 12 is an image magnified by a factor of 300. From FIGS. 10 and 12, it may be identified that the plurality of pores formed on the surface of the polishing layer are clogged or distorted by the polishing process.

On the other hand, FIGS. 11 and 13 are images of SEM measurements for the polishing layer in the polishing pad by the examples after the heat treatment, and it may be identified that the pores are formed large, the pore clogging is resolved, and the pore shapes are not distorted.

From the results of comparing polishing performance by Experimental Example 3, the new polishing pad of Comparative Example 1 had a removal rate of 2,521 Å/min and within-wafer nonuniformity of 4.60%, and the polishing pad to be discarded of Comparative Example 2 had a removal rate of 1,741 Å/min and within-wafer nonuniformity of 8.80%.

It was identified that superior polishing performance was obtained in Examples 1 to 8 compared to in Comparative Example 2, with the removal rate of 1,800 Å/min or greater and the within-wafer nonuniformity of 8.50% or less. In other words, compared to Comparative Example 2, the removal rate increases, and an excellent effect is obtained in the within-wafer nonuniformity as well.

Hereinbefore, preferred embodiments of the present disclosure have been described in detail, however, the scope of a right of the present disclosure is not limited thereto, and various modified and improved forms made by those skilled in the art using the basic concept of the present disclosure defined in the attached claims also fall within the scope of a right of the present disclosure.

REFERENCE NUMERAL

10: Installing polishing pad
20: Performing polishing process
21: Injecting slurry
22: Disk conditioning
30: Verifying time taken for polishing
31: Repeating polishing process
32: Interrupting polishing process due to exceeding target polishing time
40: Spraying water vapor to polishing pad not included in target polishing time range
41: Disk conditioning
42: Injecting slurry
50: Re-verifying time taken for polishing
51: Repeating polishing process
52: Interrupting polishing process due to exceeding target polishing time
100: Polishing pad
101: Polishing layer
102: Polishing surface
103: Pore
104: Fine concave portion
200: Surface plate
300: Nozzle unit
310: Slurry
400: Carrier
500: Semiconductor substrate
600: Conditioner
700: Water vapor spray unit
710: Heated water vapor

The invention claimed is:

1. A method for refreshing a polishing pad, the method comprising:

supplying water vapor to the polishing pad, wherein the polishing pad includes a polyurethane polishing layer provided with a polishing surface;

the polishing layer includes a plurality of pores; and the polishing surface includes a fine concave portion derived from the plurality of pores, wherein the supplying water vapor to the polishing pad is initiated in response to the polishing pad corresponding to any one or more of the following conditions i) to iv):

i) the polishing surface having ISO 25178 three-dimensional arithmetic mean surface roughness (Sa) of 6 pm or less;

ii) the polishing surface having an ISO 25178 reduced peak height (Spk) of 5 pm or less;

iii) the polishing surface having an ISO 25178 reduced valley depth (Svk) of 16 pm or less, iv) the polishing pad exhibits a removal rate of 1,500 Å/min to 1,800 Å/min and within-wafer nonuniformity (WIWNU) of 8% to 9% in a process of polishing a silicon oxide film for 60 seconds while calcined ceria slurry is supplied at a rate of 200 ml/minute, a semiconductor substrate, a subject to be polished, is pressurized with a load of 3.5 psi, the polishing pad has a rotation speed of 93 rpm and the semiconductor substrate has a rotation speed of 87 rpm, wherein the supplying of water vapor to the polishing pad is conducted while the polishing pad is installed on a surface plate, wherein the supplying of water vapor to the polishing pad is supplying water vapor of 60° C. to 120° C., wherein, after the supplying of water vapor to the polishing pad, the polishing layer has a polishing restoration index (PRI) represented by the following Equation 2 of 3.10 to 3.80:

$$PRI = \frac{(S_{pk} + S_{vk})}{S_a} \quad \text{[Equation 2]}$$

wherein,

Sa is an ISO 25178 three-dimensional arithmetic mean surface roughness of the polishing surface;

Spk is an ISO 25178 reduced peak height of the polishing surface; and

Svk is an ISO 25178 reduced valley depth of the polishing surface.

2. The method of claim 1, wherein, in the supplying water vapor to the polishing pad, a rate of change in surface roughness (Sa) of the polishing surface caused by a change in a shape of the fine concave portion is from 30% to 70% by the following Equation 1:

$$(Sa_r - Sa_f)/Sa_f \times 100 \quad \text{[Equation 1]}$$

wherein, $Sa_f$ is surface roughness (Sa) of the polishing surface immediately before supplying water vapor to the polishing pad; and $Sa_r$ is surface roughness (Sa) of the polishing surface immediately after supplying water vapor to the polishing pad.

3. The method of claim 1, further comprising conditioning the polishing surface.

4. The method of claim 3, wherein the conditioning is conditioning the polishing surface at a rotation speed of 20 rpm to 150 rpm, with an applied load of 1 lb to 90 lb and at a sweep speed of 1 to 25.

5. The method of claim 1, wherein, after the supplying of water vapor to the polishing pad, a value by the following Equation 3 is from 0.01 to 0.22:

$$\frac{|S_{pk} - S_a|}{|S_{vk} - S_a|} \quad \text{[Equation 3]}$$

wherein,

Sa is an ISO 25178 three-dimensional arithmetic mean surface roughness of the polishing surface;

Spk is an ISO 25178 reduced peak height of the polishing surface; and

Svk is an ISO 25178 reduced valley depth of the polishing surface.

6. The method of claim 1, wherein a rate of change in Svk of the polishing surface represented by the following Equation 4 is from 0.5% to 50%:

$$(Svk_r - Svk_f)/Svk_f \times 100 \quad \text{[Equation 4]}$$

wherein, $Svk_f$ is surface roughness (Svk) of the polishing surface before supplying water vapor to the polishing pad; and $Svk_r$ is surface roughness (Svk) of the polishing surface after supplying water vapor to the polishing pad.

7. A method for manufacturing a semiconductor device, the method comprising:

installing a polishing pad including a polyurethane polishing surface on a surface plate;

arranging a surface to be polished of a subject to be polished to be in contact with the polishing surface, and then polishing the subject to be polished while rotating the polishing pad and the subject to be polished relative to each other under a pressurized condition; and supplying water vapor to the polishing surface of the polishing pad, wherein the supplying water vapor to the polishing pad, is initiated in response to the polishing pad corresponding to any one or more of the following conditions i) to iv):

i) the polishing surface having ISO 25178 three-dimensional arithmetic mean surface roughness (Sa) of 6 pm or less;

ii) the polishing surface having an ISO 25178 reduced peak height (Spk) of 5 pm or less;

iii) the polishing surface having an ISO 25178 reduced valley depth (Svk) of 16 pm or less;

iv) the polishing pad exhibits a removal rate of 1,500 Å/min to 1,800 Å/min and within-wafer nonuniformity (WIWNU) of 8% to 9% in a process of polishing a silicon oxide film for 60 seconds while calcined ceria slurry is supplied at a rate of 200 ml/minute, a semiconductor substrate, a subject to be polished, is pressurized with a load of 3.5 psi, the polishing pad has a rotation speed of 93 rpm and the semiconductor substrate has a rotation speed of 87 rpm, wherein the supplying water vapor to the polishing surface of the polishing pad is conducted while the polishing pad is installed on the surface plate, wherein the supplying of water vapor to the polishing surface of the polishing pad is supplying water vapor of 60° C. to 120° C., wherein, after the supplying of water vapor to the polishing pad, a polishing layer has a polishing restoration index (PRI) represented by the following Equation 2 of 3.10 to 3.80:

$$PRI = \frac{(S_{pk} + S_{vk})}{S_a} \quad \text{[Equation 2]}$$

wherein,

Sa is an ISO 25178 three-dimensional arithmetic mean surface roughness of the polishing surface;

Spk is an ISO 25178 reduced peak height of the polishing surface; and

Svk is an ISO 25178 reduced valley depth of the polishing surface.

8. The method of claim 7, further comprising conditioning the polishing surface.

9. The method of claim 8, wherein the conditioning is conditioning the polishing surface at a rotation speed of 20 rpm to 150 rpm, with an applied load of 1 lb to 90 lb and at a sweep speed of 1 to 25.

* * * * *